US005425417A

United States Patent [19]

Carter

[11] Patent Number: 5,425,417

[45] Date of Patent: Jun. 20, 1995

[54] WELLBORE TOOL SETTING SYSTEM

[75] Inventor: Thurman B. Carter, Pearland, Tex.

[73] Assignee: Weatherford U.S., Inc., Houston, Tex.

[21] Appl. No.: 300,917

[22] Filed: Sep. 6, 1994

Related U.S. Application Data

[63] Continuation-in-part of Ser. No. 225,384, Apr. 4, 1994, which is a continuation-in-part of Ser. No. 119,813, Sep. 10, 1993, abandoned.

[51] Int. Cl.[6] ..... E21B 7/08; E21B 47/00; E21B 23/00

[52] U.S. Cl. ..... 166/117.6; 166/113

[58] Field of Search ..... 166/117.6, 117.5, 113

[56] References Cited

U.S. PATENT DOCUMENTS

| | | | |
|---|---|---|---|
| 1,570,518 | 1/1926 | Mitchell | 166/117.6 |
| 1,589,399 | 6/1926 | Kinzbach . | |
| 1,804,819 | 5/1931 | Spencer, Jr. et al. | 166/117.6 |
| 1,812,880 | 7/1931 | Kinzbach et al. | 166/117.6 |
| 1,816,856 | 8/1931 | Kinzbach et al. . | |
| 1,835,227 | 12/1931 | Lane et al. . | |
| 1,866,087 | 7/1932 | Crowell . | |
| 1,869,759 | 8/1932 | Lynch . | |
| 2,014,805 | 9/1935 | Hinderliter . | |
| 2,065,896 | 12/1936 | Keever . | |
| 2,101,185 | 12/1937 | Monroe . | |
| 2,103,622 | 12/1937 | Kinzbach . | |
| 2,105,721 | 1/1938 | Cutrer et al. . | |
| 2,105,722 | 1/1938 | Barrett et al. | 175/81 |
| 2,132,061 | 10/1938 | Walker | 166/117.6 |
| 2,170,284 | 8/1939 | Eastman | 166/117.6 |
| 2,207,920 | 7/1940 | Hughes | 175/81 |
| 2,227,347 | 12/1940 | Johnson | 175/82 X |
| 2,298,706 | 10/1942 | Kothny . | |
| 2,324,682 | 7/1943 | DeLong | 166/117.6 |
| 2,331,293 | 10/1943 | Ballard | 166/117.5 |

(List continued on next page.)

FOREIGN PATENT DOCUMENTS

WO93/15301 8/1993 WIPO .
WO94/06996 3/1994 WIPO .

OTHER PUBLICATIONS

"Kinzbach Tool Co., Inc. Catalog 1958-1959," Kinzbach Tool Company, Inc., 1958; see pp. 3-5 particularly.

(List continued on next page.)

*Primary Examiner*—Stephen J. Novosad
*Attorney, Agent, or Firm*—Guy McClung

[57] ABSTRACT

An indicator device has been invented for indicating correct orientation of an orienting receptacle and an associated wellbore tool secured to the orienting receptacle with respect to an anchor fixed in an interior of a longitudinal channel, the anchor having a top end, the indicator device having a rod having a top end and a bottom end and movably disposed in and extending through a tool central channel of the wellbore tool and with a bottom portion extending into the orienting receptacle; the bottom end of the rod disposed for contact by the top end of the anchor and the rod movable upwardly in the tool central channel by the top end of the anchor as the orienting receptacle moves down on the anchor to correctly orient the wellbore tool. A wellbore tool system has been invented for disposition in a longitudinal bore channel above and with respect to an anchor secured in the longitudinal bore channel, the anchor having a top end, the system having a wellbore tool having a top end, a bottom end, and a longitudinal tool channel therein; an orientation receptacle for receiving and contacting the top end of the anchor for orientation with respect thereto; and a movable rod with a top portion movably disposed in the longitudinal tool channel in the wellbore tool, and with a bottom portion with a bottom end projecting into the longitudinal orienting channel of the orientation receptacle for contact of the bottom end of the rod by the top end of the anchor for upward movement of the rod indicating that the orientation receptacle and its associated wellbore tool are correctly oriented with respect to the anchor and the longitudinal bore channel. A whipstock system has been invented which has such a wellbore tool system.

14 Claims, 34 Drawing Sheets

U.S. PATENT DOCUMENTS

| | | | |
|---|---|---|---|
| 2,445,100 | 7/1948 | Wright | 166/117.6 |
| 2,495,439 | 1/1950 | Brinble | 175/81 |
| 2,567,507 | 9/1951 | Brown | 166/117.5 |
| 2,586,878 | 2/1952 | Staton . | |
| 2,633,331 | 3/1953 | Hampton . | |
| 2,664,162 | 12/1953 | Howard et al. | 116/117.5 |
| 2,699,920 | 1/1955 | Zublin | 166/117.6 |
| 2,770,444 | 11/1956 | Neal | 166/117.6 |
| 2,797,893 | 7/1957 | McCune et al. | 175/79 |
| 2,882,015 | 4/1959 | Beck . | |
| 2,950,900 | 8/1960 | Wynes | 175/61 |
| 3,000,440 | 9/1961 | Malcomb | 166/4 |
| 3,075,583 | 1/1963 | Nielsen | 166/117.5 |
| 3,095,039 | 6/1963 | Kinzbach | 166/117.6 |
| 3,096,824 | 7/1963 | Brown | 166/210 |
| 3,116,799 | 1/1964 | Lemons | 175/61 |
| 3,172,488 | 3/1965 | Roxstrom | 175/81 |
| 3,667,252 | 6/1972 | Nelson | 64/23.5 |
| 3,908,759 | 9/1975 | Cagle et al. | 166/117.6 |
| 4,007,797 | 2/1977 | Jeter | 175/26 |
| 4,153,109 | 5/1979 | Szescila | 166/250 |
| 4,266,621 | 5/1981 | Brock | 175/329 |
| 4,285,399 | 8/1981 | Holland et al. | 166/113 |
| 4,304,299 | 12/1981 | Holland et al. | 166/255 |
| 4,307,780 | 12/1981 | Curington | 166/113 |
| 4,397,360 | 8/1983 | Schmidt | 175/61 |
| 4,429,741 | 2/1984 | Hyland | 166/63 |
| 4,450,912 | 5/1984 | Callihan et al. | 166/289 |
| 4,491,178 | 1/1985 | Terrell et al. | 166/192 |
| 4,550,781 | 11/1985 | Kagler et al. | 166/340 |
| 4,646,826 | 3/1987 | Bailey et al. | 166/55.3 |
| 4,665,995 | 5/1987 | Briathwaite et al. | 175/45 |
| 4,733,732 | 3/1988 | Lynch | 175/61 X |
| 4,765,404 | 8/1988 | Bailey et al. | 166/117.6 |
| 4,807,704 | 2/1989 | Hsu et al. | 166/313 |
| 4,844,167 | 7/1989 | Clark | 175/4.53 |
| 4,938,291 | 7/1990 | Lynde et al. | 116/55.8 |
| 4,984,488 | 1/1991 | Lunde et al. | 76/115 |
| 5,014,778 | 5/1991 | Lynde et al. | 166/55.5 |
| 5,086,838 | 2/1992 | Cassel et al. | 166/55.6 |
| 5,109,924 | 5/1992 | Jurgens et al. | 166/117.5 |
| 5,113,938 | 5/1992 | Clayton | 166/117.6 |
| 5,115,872 | 5/1992 | Brunet et al. | 175/61 |
| 5,154,231 | 10/1992 | Bailey et al. | 166/298 |
| 5,163,522 | 11/1992 | Eaton et al. | 175/58 |
| 5,195,591 | 3/1993 | Blount et al. | 166/380 |
| 5,211,715 | 5/1993 | Braden et al. | 175/58 |
| 5,222,554 | 6/1993 | Blount et al. | 166/117.6 |
| 5,253,710 | 10/1993 | Carter et al. | 166/298 |
| 5,265,675 | 11/1993 | Hearn et al. | 166/297 |
| 5,277,251 | 1/1994 | Blount et al. | 166/117.5 |
| 5,287,921 | 2/1994 | Blount et al. | 166/117.6 |
| 5,287,922 | 2/1994 | Bridges | 166/277 |
| 5,318,121 | 6/1994 | Brockman | 166/313 |
| 5,318,122 | 6/1994 | Murray et al. | 166/313 |
| 5,322,127 | 6/1994 | McNair et al. | 166/313 |
| 5,335,737 | 8/1994 | Baugh | 175/61 |
| 5,341,873 | 8/1994 | Carter et al. | 166/117.5 |
| 5,346,017 | 9/1994 | Blount et al. | 166/380 |

OTHER PUBLICATIONS

"Dual horizontal extension drilled using retrievable whipstock," Cress et al, Worked Oil, Jun. 1993, five pages.

"Casing Whipstocks," Eastman Whipstock, Compsite Catalog, p. 2226, 1976–1977.

"Bowen Shipstocks," Bowen Oil Tools, Compsoite Catalog, one page, 1962–1963.

"Improved Casing Sidetrack Procedure Now Cuts Wider, Larger Windows," Cagle et al, Petroleum Engineer International, Mar. 1979.

"Weatherford Fishing and Rental Tool Services," 1993.

"A-1 Bit & Tool company" 1990–01 General Catalog, pp. 8, 14.

"TIW SS-WS Shipstock Packer Information," Texas Iron Works, Inc., 1987.

WELLBORE TOOL SETTING SYSTEM

RELATED APPLICATION

This is a continuation-in-part of U.S. Application Ser. No. 08/225,384, filed on Apr. 4, 1994 entitled "Wellbore Tool Orientation," which is a continuation-in-part of U.S. Application Ser. No. 08/119,813 filed on Sep. 10, 1993 entitled "Whipstock System", now abandoned.

BACKGROUND OF THE INVENTION

1. Field Of The Invention

The present invention is related to: receptacles for wellbore anchors; keys for such anchors; anchors with such keys; stabilizers for whipstocks; standoff and support apparatus for wellbore tool member, e.g. a concave member of a whipstock; whipstocks and associated apparatus for use in wellbores; locking assemblies, both releasable and permanent, for locking into wellbore tools; whipstocks insertable through one tubular into another, e.g. through smaller tubing into larger casing; whipstock installation tools; survey tool assemblies; whipstock apparatus which can be set by pulling upwardly thereon; whipstock systems with mechanisms for preventing system actuation until a whipstock is correctly oriented with respect to an anchor member; such mechanisms themselves; indicator devices for indicating correct orientation of a wellbore orienting receptacle with respect to an anchor; and to anchoring apparatus for use in tubulars. In certain aspects these items or combinations of them are insertable through a smaller diameter tubular, e.g. tubing, into a tubular of larger diameter, e.g. casing.

2. Description of Related Art

A variety of "through tubing" whipstocks and tools insertable through tubing are available in the prior art; e.g. the devices disclosed in U.S. Pat. Nos. 5,287,921; 5,265,675; 5,277,251; 5,222,554; 5,211,715; 5,195,591; and 4,491,178.

There is a need for the stabilization of a whipstock concave member disposed in a wellbore during milling operations. There is a need for an effective whipstock and associated apparatus which is insertable through a smaller diameter tubular, such as tubing, and then disposable in a larger diameter tubular, such as casing, below the smaller diameter tubular. There is a need for such devices which effectively anchor and correctly orient themselves in the larger diameter tubular. There is a need for an efficient and effective orientation apparatus for wellbore tools and for an anchor for effective use with such orientation apparatus. There is a need for such an orientation apparatus which is re-settable if correct orientation is not initially achieved.

SUMMARY OF THE PRESENT INVENTION

The present invention in one embodiment discloses an orientation apparatus for wellbore tools, the apparatus having a receptacle for a wellbore anchor, the receptacle having a tapered nose with curved surfaces for contacting one of two opposed curved surfaces of a key on the anchor. In one aspect such a receptacle is used with an anchor receiving member in a two stage method—a first releasable holding stage and a second non-releasable locking stage. In one aspect the receptacle's and key's curved surfaces are configured so that following contact at any point along the receptacle's curved surface by either of the key's curved surfaces, the receptacle and anchor move into a correct orientation with respect to each other and then a stinger on the anchor moves into upper locking apparatus which non-releasably grip and lock the stinger in place. In one aspect, releasable gripping apparatus is used in the lower alignment assembly and after the stinger has entered a lower alignment assembly in the receptacle, but has not yet entered the upper locking apparatus, the orientation assembly is still releasable from the stinger (and anchor) by pulling up on the orientation assembly. The orientation assembly need not be raised and removed from the wellbore to attempt again to achieve correct tool setting and orientation. The orientation assembly needs only to be separated from the anchor and then relowered to proceed with engagement of the stinger and its associated anchor. Such an orientation assembly is insertable through a tubular of small diameter into a tubular of larger diameter for use therein.

In one embodiment the present invention discloses a wellbore anchor with a body, anchoring apparatus for anchoring the anchor in the wellbore, and a guide key on the body, the guide key having opposed curved surfaces which meet along a line at a tip of the key, the curved surfaces configured and disposed to contact and co-act with corresponding curved surfaces on a receptacle moving down to encounter the anchor. In one aspect such a guide key is relatively more massive than a circular pin or cylindrical member typically used to facilitate such co-action between a receptacle and an anchor. The guide then can be formed integrally of or secured to a body of an anchor. Such anchors according to this invention may be designed, configured, and sized to be insertable through a tubular or tubular string, e.g. but not limited to tubing, of relatively small inner diameter prior to activation so that they can be moved through the tubular into a tubular of larger diameter in which the tubular of smaller diameter is positioned. The guide key secured to an anchor body can be secured with a bolt or pin (and have a corresponding hole therethrough for such securement), or it can be bonded or molded to the anchor body. In one aspect a guide key according to this invention has a base which includes a portion below the opposed curved surfaces. The base fits into a corresponding slot or recess in the anchor body for stabilization of the key in place with respect to the anchor body. This invention includes such guide keys, anchors with such a key, and designs for both.

In one embodiment the present invention discloses a lower alignment assembly for use with a receptacle of an orientation apparatus which facilitates reception into the receptacle of another member, including but not limited to a part of a wellbore anchor (e. g. a stinger) thereof. In one aspect such a lower alignment assembly moves with the other member as it approaches and then co-acts with additional gripping, locking, and/or alignment apparatus in the receptacle. In one aspect such a lower alignment assembly has releasable gripping apparatus which releasably grips the other member and releases the member (e.g. an anchor stinger) in response to pulling up on the receptacle.

In one embodiment the present invention discloses a standoff or support apparatus for a wellbore tool. Such apparatus is useful to maintain a position of a wellbore tool and/or to provide a member against which a force can act without unwanted movement of the member upon which the force acts. In one aspect such apparatus includes a releasable pin extending through the body of a wellbore tool and a pad on the pin. Upon release of the pin, the pin moves away from the tool so that the pad contacts the interior surface of the wellbore or of a tubular in which the tool is disposed, e.g. casing. Locking apparatus prevent the pin from returning into the tool. In another embodiment a first toothed bar is movably disposed with respect to a second toothed bar secured to a wellbore tool. Release of the first toothed bar and its upward movement forces the second toothed bar outwardly away from the tool to contact an interior surface of a wellbore or tubular. Appropriate apparatus is used to prevent the second bar from moving back toward the tool; e.g. but not limited to ratcheting teeth on the opposed bars or teeth configured with flat bases which meet and then prevent bar movement. In one aspect such standoff or support apparatus is useful with a concave member of a whipstock disposed in a casing and is insertable through a tubing string extending down into the casing to exit the tubing for activation in casing below the bottom end of the tubing string.

In one embodiment of the present invention one or more standoff or support apparatuses according to the present invention are used with a member (including but not limited to a flat bar, a solid or hollow tubular, part of a whipstock assembly, or a whipstock concave member) to anchor the member in place in a wellbore or in a tubular member (such as casing, drill pipe, or tubing). By employing one or more standoff or support apparatus according to the present invention such a member may be oriented at a desired angle with respect to a wellbore and/or other tubular in which the member is disposed. In one aspect such a member with an appropriate series of standoff or support apparatuses (including but not limited to a combination of different apparatuses disclosed here) may be used without a typical wellbore anchor, without (and in place of) a typical whipstock concave member, and/or without a typical whipstock assembly for directional drilling operations and/or directional milling operations.

The present invention, in one embodiment, discloses a whipstock system having an orientation device; a flexion member releasably secured to the orientation device; co-acting lower and upper body members, the lower body member interconnected with the flexion member; a connecting bar which connects the upper and lower body members permitting the upper body member to move downwardly with respect to the lower body member while preventing separation of the two body members; and a concave member secured to and above the upper body member. In one preferred embodiment, one or more movable pawls on the connecting bar move to engage surfaces on one or both body members to prevent upward movement of the upper body member with respect to the lower body member, or conversely movement of the lower body member downwardly away from the upper body member; and movement of the one or more pawls in contact with both body members also forces the two body members apart further stabilizing the system in a tubular.

In one embodiment of such apparatus, movement of the lower body member sideways up against a casing wall for frictional engagement therewith is facilitated by the use of a notched tube connected between the lower body member and the flexion member. The flexion member itself further facilitates such movement of the lower body member since it, preferably, has a reduced area neck which enhances flexing of the flexion member. To enhance frictional contact of the lower body member with the casing, one or more friction members or pads, or toothed slip members can be provided on the exterior of the lower body member which move to contact and frictionally engage the casing's interior surface as the lower body member moves against the casing. One or more toothed members or toothed slips may be used and teeth on different members or slips may be oriented differently; e.g. on one slip teeth may be oriented downwardly to prevent downward movement of the device and on another slip teeth may be oriented upwardly to engage e.g. a casing to prevent upward movement. Initially the total effective largest dimension of the two body members is sufficiently small that they are insertable through a tubular (e.g. tubing) of a relatively small diameter. Then as they move apart with respect to each other the total effective largest dimension of the two body members increases so that one or both engage the interior of a relatively larger diameter tubular (e.g. casing) in which the smaller diameter tubular is positioned.

In one embodiment the connecting bar has an I-shaped cross-section and the upper and lower body members each have a groove with a corresponding shape for receiving part of the connecting bar. Thus the connecting bar prevents the two body members from separating or rotating with respect to each other while at the same time allowing the upper body member to move downwardly adjacent the lower body member permitting the two to move sideways to a controlled extent with respect to each other. Preferably the upper and lower body members are disposed at an angle to each other and the connecting bar is configured and the associated body member grooves are disposed so that as the upper body member moves downwardly with respect to the lower body member, the lower body member contacts and frictionally engages one interior side of the casing and the upper body member moves to contact the other side of the casing's interior; thus stabilizing the apparatus in place. At this point an upward force may be applied to the apparatus, causing the pawls to lock the lower and upper body members together, preferably pushing them slightly farther apart to further stabilize them in place and setting the whipstock in place at the desired location. Further pulling frees any upper setting tool or installation tool, leaving the whipstock correctly positioned.

Appropriate orienting devices are used so that the concave member is correctly oriented with respect to the wellbore to direct a milling tool in a desired direction. Correct orientation of the whipstock system with respect to an anchor in the casing is facilitated in certain preferred embodiments by an installation tool secured to the top of the concave member. The installation tool has a mandrel secured to the concave member, the mandrel rotatable within an upper housing which is itself secured to an upper sub which is threadedly connected to the tool string from which the whipstock is suspended. Preferably the installation tool does not transmit torque to apparatus below it due to the mandrel's rotation. The orienting device at the bottom of the whipstock system may include a scooped receptacle which rotates to correctly orient with respect to and to engage an anchor disposed in the casing.

In one embodiment friction reducing members, substances, or pads may be used on the upper body member to reduce friction between it and the casing so that the upper body member may move downwardly to force the lower body member against the casing's interior and to enhance engagement of a toothed slip or slips on the lower body member with the casing's interior.

In other embodiments, the present invention discloses a whipstock system having: a lower inflatable packer with an orientation key; a stinger assembly with a slot for the key for co-acting with the packer to orient the system; stabilizing springs on the stinger assembly; linking apparatus for pivotably linking the stinger assembly to a lower body member; the lower body member preferably with one or more friction members such as a slip with a toothed surface; a wedge slide member movably secured partially within the lower body member and partially within an upper body member; an upper body member shear-pinned to the lower body member so that upon sheafing of one or more pins, forcing the upper body member downwardly with respect to the lower body member and forcing the lower body member outwardly, the movement of the two body members constrained and guided by the wedge slide so that the lower body member moves sideways to contact an interior surface of casing in which the system is disposed while the upper body member moves to contact an opposing interior casing surface; the linking apparatus permitting pivoting of the lower body member so it moves sideways; and a whipstock concave member secured to the upper body member, preferably secured pivotably so that concave member lays back against the casing interior at a desired angle to effect a desired milling point and direction. A setting tool is secured to the concave member by a shear stud. In effect the overall largest dimension of the system at the interface of the upper and lower bodies increases as the two move with respect to each other. Thus the system is initially of a first smaller dimension so it is insertable through a relatively small diameter tubular (such as tubing) into a larger diameter tubular (e.g. casing) which extends downwardly beyond the smaller diameter tubular. Then, upon movement of the two body members with respect to each other the effective largest dimension at the body members increases and the body members, by frictional contact with the interior of a relatively larger diameter tubular (e.g. casing in which tubing is disposed), anchor the system with the larger diameter tubular for use therein. The above-described upper and lower bodies and associated interconnecting apparatus, wedge slide, or connecting bar with pawl(s), may be used to anchor any member or device in any tubular or wellbore. Also, friction members such as pads of friction materials and/or toothed slips with teeth pointed upwardly and/or toothed slips with teeth pointing downwardly may be used on both or either body members. Alternatively friction reducing members, devices, or substances may be used on the upper body member to facilitate its downward movement.

In another embodiment of a whipstock system according to the present invention which is similar to that described immediately above, there is no wedge slide member. Interconnecting apparatus such as a linking member (or members) is used to pivotably link a concave member to a lower body member so that downward force on the concave member results in the movement of both the lower body member and the concave member to contact the casing wall. The lower body member pivots with respect to the stinger assembly and moves sideways to frictionally engage one interior side of the casing while the concave member has a bottom portion that pivots with respect to the lower body member and moves sideways (away from the lower body member) to contact the opposite interior side of the casing.

In certain embodiments the present invention teaches a split lock ring for engaging a portion or shaft of a wellbore tool, including but not limited to a top cylindrical portion or stinger of a wellbore anchor apparatus. Such a lock ring in one aspect has locking or releasing interior threads which threadedly mate with exterior threads on the wellbore tool to be held. Such a lock ring in one aspect has a lower projection with an inclined surface configured and positioned to rest on and move downwardly with respect to a correspondingly inclined surface on an associated assembly so that a tool with a shaft or stinger within the lock ring, pulled down on the lock ring, forces the lock ring's inclined surface down on the inclined surface of the associated assembly, thereby increasing the force of the lock ring holding the shaft or stinger therein.

In certain embodiments the present invention discloses a survey tool assembly which includes a receptacle as previously described with a releasable lower locking assembly and: no other locking assembly therein; or a releasable additional upper locking assembly therein. The survey tool assembly also has an orientation indicator (e.g. but not limited to commercially available gyroscopic indicator assemblies) secured to the receptacle.

The present invention, in one embodiment, discloses a whipstock system having an orientation device; a flexion member releasably secured to the orientation device; co-acting lower and upper body members, the lower body member interconnected with the flexion member; a connecting bar which connects the upper and lower body members permitting the upper body member to move downwardly with respect to the lower body member while preventing separation of the two body members; a concave member on the upper body member; and an installation tool releasably secured to the concave member. To prevent system actuation and setting before the tool is correctly oriented with an anchor member below the system, a rod or series of rods are provided which extend from within the receptacle and flexion member, through the lower body member to co-act with a movable block extending from the lower body member and releasable therefrom. The movable block initially is held immovable; i.e., it prevents setting of the system. The rod(s) move upwardly in response to contact by the anchor to move the movable block so that the upper body member is freed for movement with respect to the lower body member. The rod(s) are positioned so that rod movement to move the movable block does not occur until a part of the anchor has contacted and pushed against a lower end of the rod—and this does not occur until the orientation device (and therefore the system) is correctly oriented with respect to the anchor and, therefore, with respect to the wellbore and/or with respect to a string of tubing or casing in which the whipstock is disposed In one embodiment an indicator device according to the present invention for is disclosed for indicating correct orientation of an orienting receptacle and an associated wellbore tool secured to the orienting receptacle with respect to an anchor fixed in an interior of a longitudinal channel, the anchor having a top end, the indicator device having a rod having a top end and a bottom end and movably disposed in and extending through a tool central channel of the wellbore tool and with a bottom portion extending into the orienting receptacle, and the bottom end of the rod disposed for contact by the top end of the anchor and the rod movable upwardly in the tool central channel by the top end of the anchor as the orienting receptacle moves down on the anchor to correctly orient the wellbore tool. One such indicator device (wherein tool setting apparatus is interconnected with the wellbore tool for setting the wellbore tool in the wellbore, the tool setting apparatus having a holding device preventing tool setting,) has the rod movable in response to the top end of the anchor to move the top end of the rod to contact the holding device and move it so it no longer prevents tool setting. In one such indicator device the wellbore tool includes a whipstock system with an upper body member movable with respect to a lower body member and the tool setting apparatus includes at least one gripping element movable to engage the interior surface of the longitudinal channel, the longitudinal channel is a channel through the interior of an oil well tubular member, the holding device initially prevents movement of the upper body member with respect to the lower body member, and the upper body member has a whipstock concave member thereon. One such indicator device has a holding device with a movable block which initially contacts the lower body member and the upper body member preventing relative movement of the two body members, and the rod is movable to contact and move the movable block away from the lower body member freeing the upper body member for movement with respect to the lower body member. The rod may have two or more sub-rods releasably secured together.

A wellbore tool system according to one embodiment of the present invention for disposition in a longitudinal bore channel above and with respect to an anchor secured in the longitudinal bore channel (the anchor having a top end) has a wellbore tool having a top end, a bottom end, and a longitudinal tool channel therein; an orientation receptacle for receiving and contacting the top end of the anchor for orientation with respect thereto to orient the wellbore tool with respect to the longitudinal bore channel, the orientation receptacle secured beneath the wellbore tool and having a longitudinal orienting channel therein; and a movable rod with a top portion movably disposed in the longitudinal tool channel in the wellbore tool, and with a bottom portion with a bottom end projecting into the longitudinal orienting channel of the orientation receptacle for contact of the bottom end of the rod by the top end of the anchor for upward movement of the rod indicating that the orientation receptacle and its associated wellbore tool are correctly oriented with respect to the anchor and the longitudinal bore channel. One such system has setting apparatus for securing the wellbore tool in place in the longitudinal bore channel; holding apparatus for initially preventing actuation of the setting apparatus; and the rod movable in response to the top end of the anchor to contact the holding apparatus and move the holding apparatus so that the setting apparatus is freed to set the wellbore tool in place. In one such system the wellbore tool includes a whipstock system, the whipstock system having an upper body member with a concave upper portion and a lower body member interconnected with the orientation receptacle, and the holding apparatus has a connection bar interconnected between the two body members and movable with respect thereto to guide their movement with respect to each other. In one such system the holding apparatus has a movable block movably secured to the upper body member and initially contacting the lower body member and preventing relative movement of the two body members thereby preventing setting of the whipstock system in place, the rod movable in response to orienting of the orientation receptacle with respect to the anchor to move the movable block away from the lower body member freeing the body members for movement to permit setting of the whipstock system. One such system includes an installation tool removably secured to the upper body member and securable to a string of tubular members for inserting the whipstock system into the string of tubular members and the longitudinal bore channel is a central channel through a string of tubing in a wellbore. One such system includes connection apparatus interconnecting the lower body member and the orientation receptacle with the rod extending through and movable through the connection apparatus.

It is, therefore, an object of at least certain preferred embodiments of the present invention to provide:

New, useful, unique, efficient, nonobvious whipstocks and devices for installing them in tubulars;

Such devices for insertion through a smaller diameter tubular in a larger diameter tubular; in one aspect, for insertion through tubing into casing extending below the tubing;

Such devices for effective anchoring of a whipstock in a tubular; and, in one aspect, a whipstock apparatus settable by pulling upwardly thereon;

Such devices for correct orientation of a whipstock with respect to an anchor disposed in casing below tubing therein;

New useful, unique, efficient, nonobvious anchoring devices for anchoring a member or device in a tubular or in a wellbore;

New useful, unique, efficient, and nonobvious orienting keys for anchoring devices; anchoring devices with such a key; and designs for both;

New useful, unique, efficient, nonobvious standoff and/or support apparatus for wellbore tools, including, but not limited to, whipstock concave members;

New, useful, unique, efficient, nonobvious split lock rings for holding a wellbore tool and designs therefor;

New, useful, unique, efficient, nonobvious survey tool assemblies with a receptacle according to this invention, one or more releasable locking devices according to this invention within the receptacle, and an orientation indicating device secured to the receptacle;

New useful, unique, efficient, nonobvious setting or installation tools for whipstock orientation which permit relative rotation of a whipstock system and items above the whipstock system in a tool string or tubular string and which, preferably, do not transmit torque;

New useful unique efficient nonobvious mechanisms for preventing whipstock system setting until the system is correctly oriented with respect to an anchor and/or with respect to a wellbore;

New, useful, unique, efficient, nonobvious devices for indicating correct orientation of a wellbore orienting receptacle with respect to an anchor; and New, useful, unique, efficient, nonobvious toggling connections for connecting two members.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention should be read to include any legally equivalent devices or methods which do not depart from the spirit and scope of the present invention.

The present invention recognizes and addresses the p and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 19G is an enlargement of a split lock ring shown in FIG. 19E. FIGS. 19D–G show an upper locking assembly according to the present invention.

DESCRIPTION OF EMBODIMENTS PREFERRED AT THE TIME OF FILING FOR THIS PATENT

Figure 1:
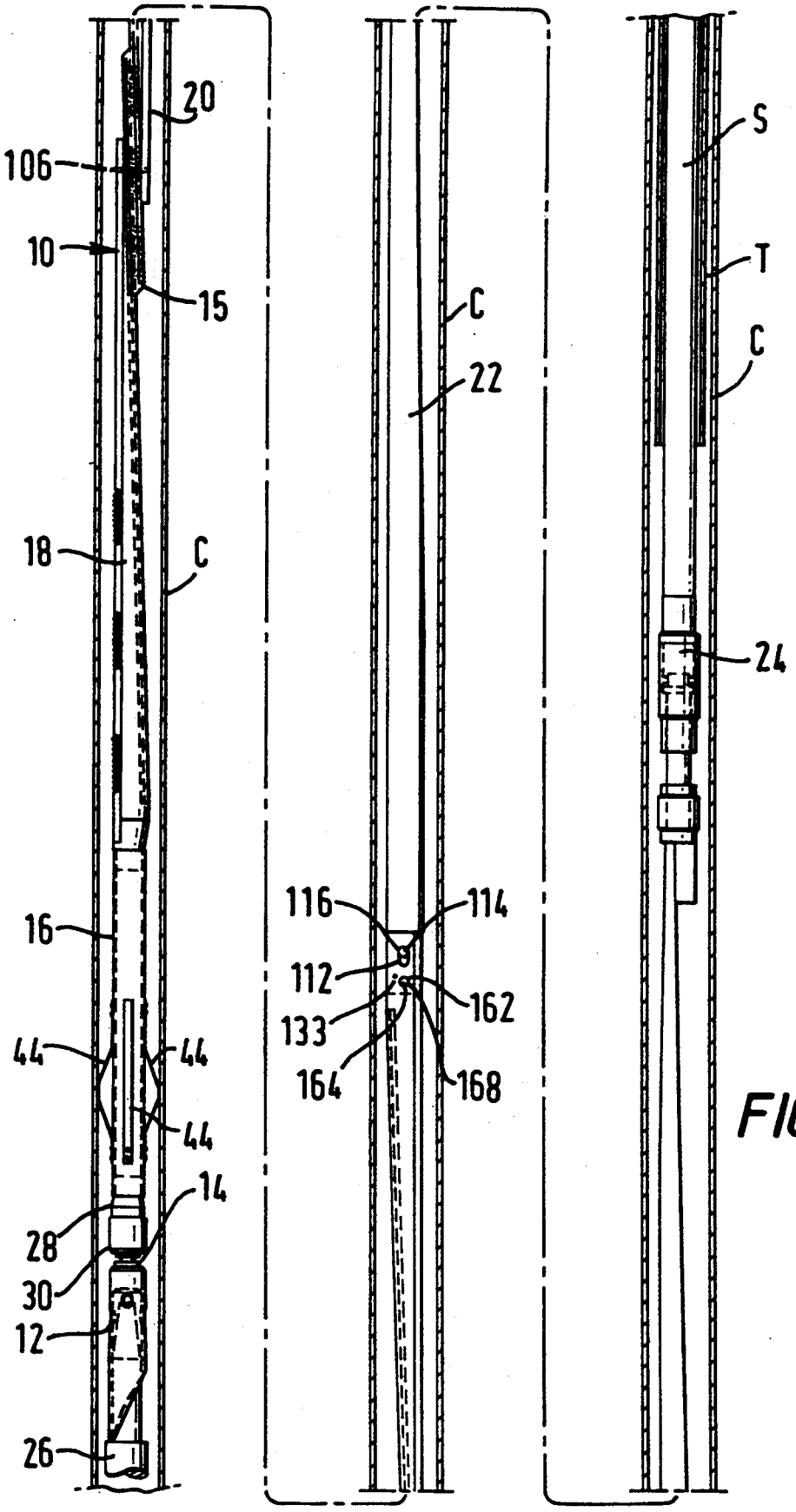
FIG. 1 is a side cross-sectional view of a whipstock system according to the present invention.
Figure 2:
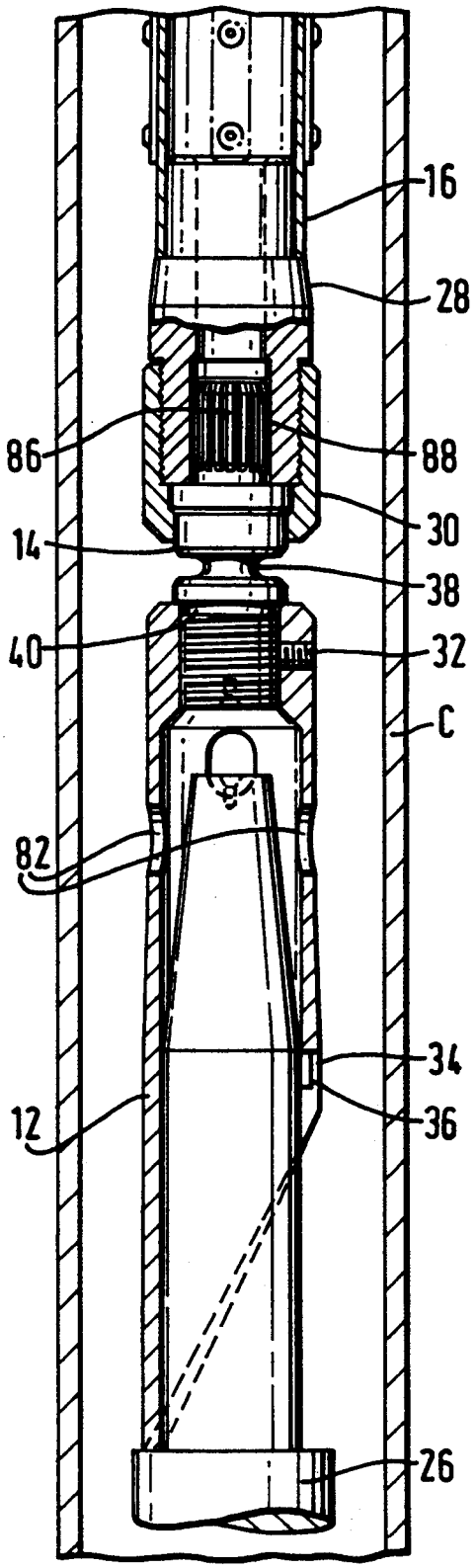
FIG. 2 is a side cross-sectional view of part of the system of FIG. 1 including a splined flexion member.

Referring now to FIG. 1, a whipstock system 10 according to the present invention has a lower receptacle 12 to which is secured a splined flexion member 14 by set screws 32. A locking nut 30 secures a top end of the splined flexion member 14 to an adapter 28. The adapter 28 is welded to a tube 16 which itself is welded to a lower end of a lower body member 18. A connecting bar 15 interconnects the lower body member 18 and an upper body member 20. A concave member 22 is secured to a top of the upper body member 20. An installation tool 24 is releasably secured to a top of the concave member 22.

As shown in FIG. 1, the system 10 has been inserted on a string S which typically includes (from the installation tool up) a crossover sub, a drill collar (for weight), a connector to the drill collar, and a length of coiled tubing which extends to the surface. The tubing T extends through casing C and the casing C extends downwardly below the tubing T. The receptacle 12 has a key slot 34 for receiving a key 36 on a lower anchor member 26 previously emplaced in the casing C, thus correctly orienting the system 10 in a desired orientation with respect to the casing C and therefore with respect to a wellbore (not shown) in which the casing is installed.

Figure 6A:
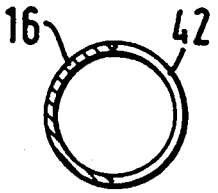
FIG. 6A is a cross-sectional view through the notch of the tube of FIG. 6B.
Figure 6B:
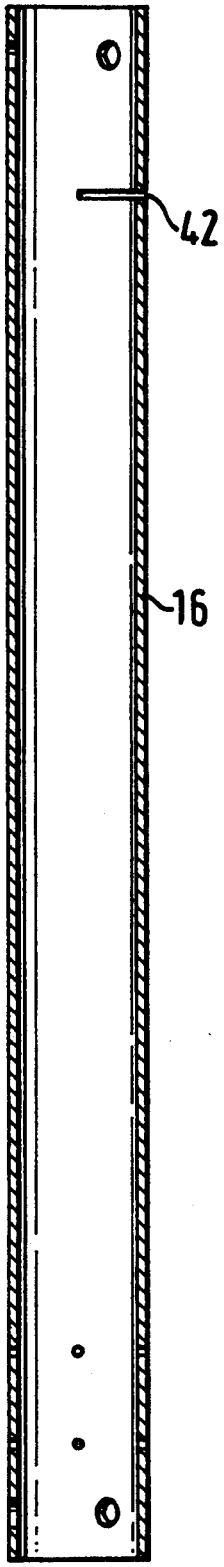
FIG. 6B is a side cross-sectional view of the tube of the system of FIG. 1.

Sideways movement of the lower body member 18 is permitted and facilitated by two items: the splined flexion member 14 and the notched tube 16 so that the lower body member will move sideways as desired up against an interior side wall of the casing C. The splined flexion member 14 has a neck 38 of reduced size as compared to the size of a body 40 of the member 14. The splined flexion member 14 (in one embodiment made from steel) flexes at the neck 38. The tube 16 has one (or more) notches 42 cut therethrough which permit the tube 16 to bend to a small degree. As shown in FIG. 6A the notch 42 occupies half of the circumference of the tube 16. Four centralizing bow springs 44 (three shown in FIG. 1) are disposed on the tube 16.

Figure 4:
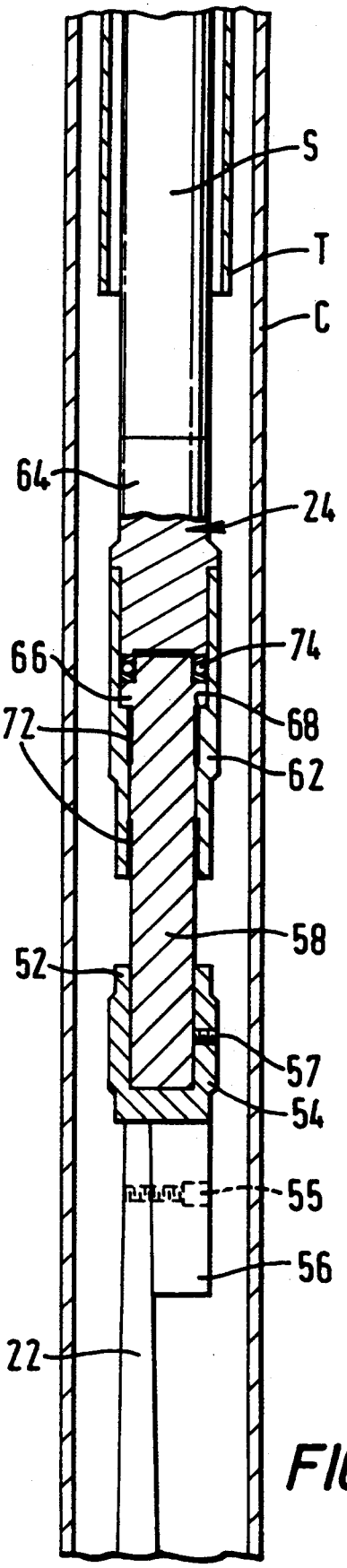
FIG. 4 is, a side cross-sectional view of an installation tool of the system of FIG. 1.

FIG. 4 illustrates the installation tool 24 according to the present invention. The tool 24 has a lower adapter 52 with a sleeve 54 and a block 56. The block 56 is secured to the concave member 22 with a screw 55. A mandrel 58 is threadedly engaged within the sleeve 54 and a set screw 57 prevents rotation of the mandrel 58 in the sleeve 54. The mandrel 58 is rotatable within a housing 62. The housing 62 threadedly engages an upper sub 64. The upper sub 64 interconnects the system 10 to connectors and to connectors and to tubing extending from the surface and into the casing. The mandrel 58 has a flange 66 which abuts an interior shoulder 68 of the housing 62. Brass sleeve bearings 72 facilitate rotation of the mandrel 58. A thrust bearing 74 serves to facilitate rotation of the mandrel 58 with respect to the sub 64 when downward force is applied to the sub 64. The screw 55 does not experience a downward force when the system is being run into the hole since the bottom surface of the sleeve 54 abuts a top surface of the concave. When the screw 55 shears (after the tool is set and the system above the installation tool is to be removed) the shoulder 68 is pulled up against the flange 66 to remove the installation tool 24 from the hole.

Figure 5A:
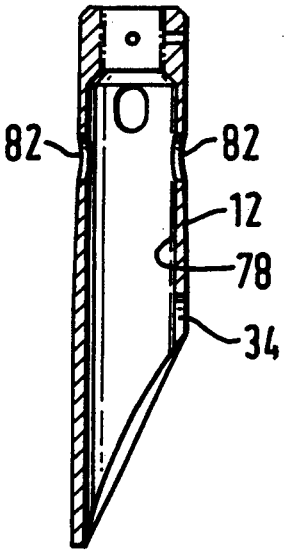
FIG. 5A is a side cross-sectional view of a receptacle of the system of FIG. 1.
Figure 5B:
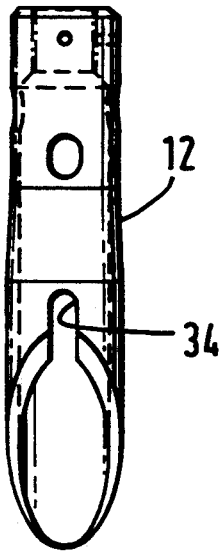
FIG. 5B is a front view of the receptacle of FIG. 5A.

FIGS. 5A and 5B show the receptacle 12. It has a key slot 34 for receiving the key 36 on the anchor 26. Material and debris entering a channel 78 exit through ports 82. Set screws 32 hold the receptacle 12 on a lower end of the splined flexion member 14.

Figure 7:
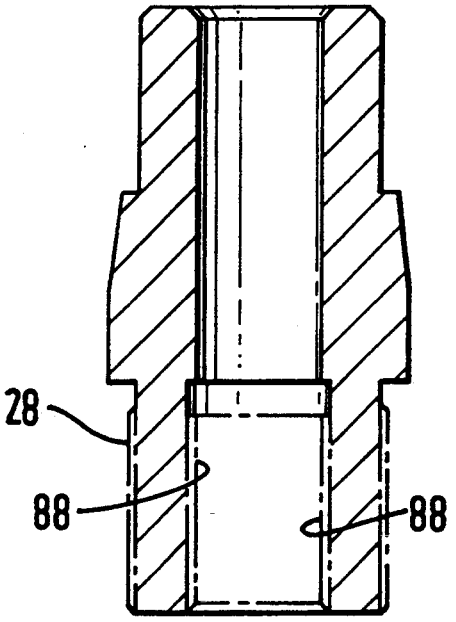
FIG. 7 is a is a side cross-sectional view of the adapter of the system of FIG. 1.
Figure 8:
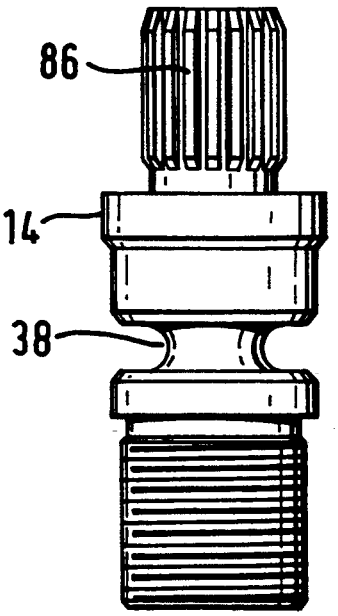
FIG. 8 is a side cross-sectional view of the splined flexion member of the system of FIG. 1.

As shown in FIGS. 7 and 8, external splines 86 on a top end of the splined flexion member 14 mate with internal spline recesses 88 in the adapter 28. The splined flexion member 14 (or alternatively the adapter 28) can be rotated to achieve a desired orientation of the receptacle 12 with respect to the adapter 28 and hence with respect to the rest of the system. When the desired position is achieved, the splined flexion member's top end is inserted into the adapter 28 and the locking nut 30 is tightened on the adapter 28. Further rotation of the receptacle 12 can be achieved by rotating the entire system 10 at the mandrel 58—housing 62 interface of the installation tool 24. This can be done above the surface prior to insertion of the system 10 into a tubular or wellbore.

Figure 10A:
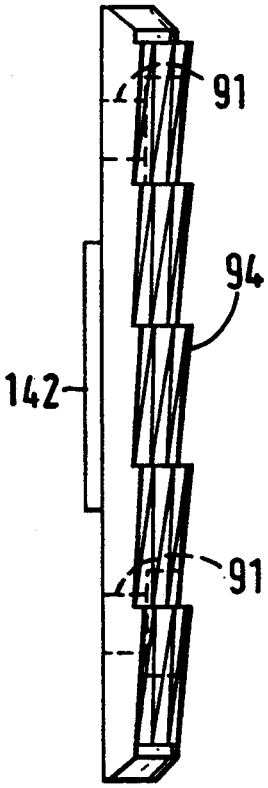
FIG. 10A is a perspective view of a friction member of the system of FIG. 1.
Figure 10B:
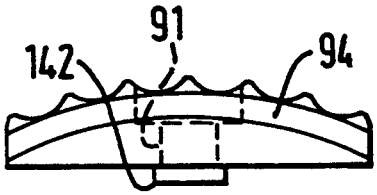
FIG. 10B is a top view of the friction member of FIG. 10A.
Figure 11A:
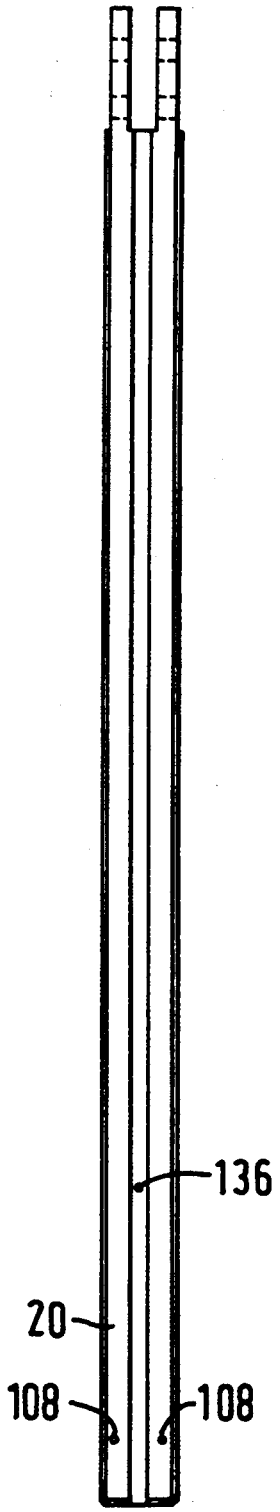
FIG. 11A is a side view of an upper body member of the system of FIG. 1.
Figure 11B:
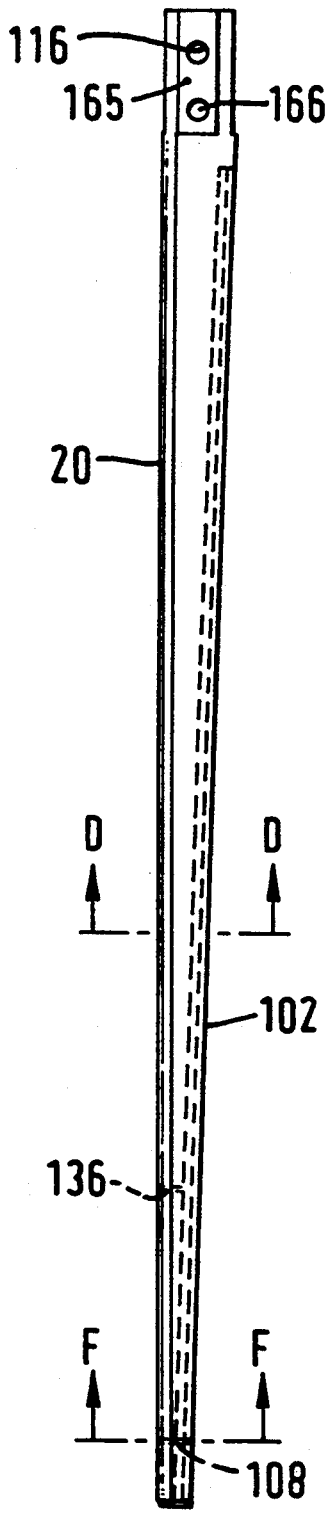
FIG. 11B is another side view of the upper body member of FIG. 11A.
Figure 11C:
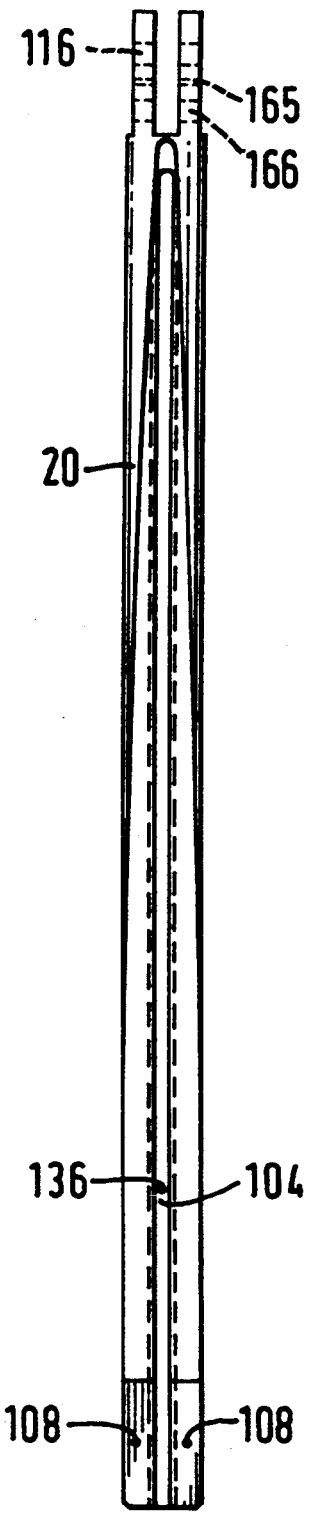
FIG. 11C is another side view of the upper body member of FIG. 11A.
Figure 11D:
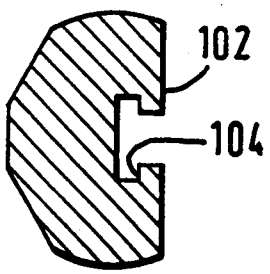
FIG. 11D is a cross-sectional view along line D—D of FIG. 11B.
Figure 11E:
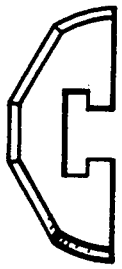
FIG. 11E is a bottom end view of the upper body member of FIG. 11B.
Figure 11F:
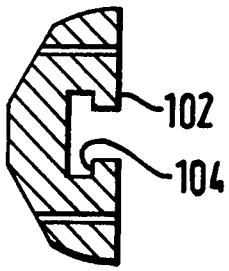
FIG. 11F is a cross-sectional view along line F—F of FIG. 11B.
Figure 12D:
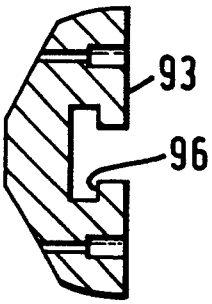
FIG. 12D is a cross-sectional view along line A—A of FIG. 12B.
Figure 12E:
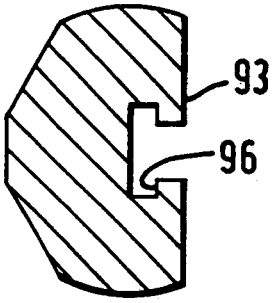
FIG. 12E is a cross-sectional view along line B—B of FIG. 12B.
Figure 12F:
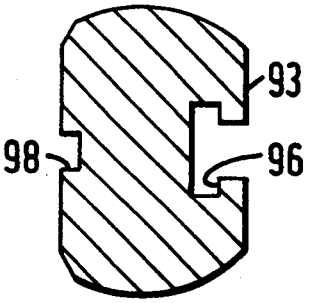
FIG. 12F is a cross-sectional view along line C—C of FIG. 12B.

The lower body member 18, shown in FIGS. 1 and 12A–12F, has one or more recesses 92 in which are mounted friction members 94 (see FIG. 10A). As shown, the lower body member 18 tapers from top to bottom having a taper surface 93 and a T-shaped groove 96 along its length which holds the connecting bar 15 and guides the movement of the connecting bar 15. A slot 98 in each recess 92 facilitates emplacement of rear ribs 142 of the friction members 94; and screws 99, extending through holes 91 in the friction members 94 and into holes 95 in the lower body member 18, hold the friction members 94 in place. Holes 97 at the top of the lower body member 18 receive shear members for interconnecting the connecting bar 15 and the upper body member 20.

The upper body member 20, shown in FIGS. 1 and FIGS. 11A–11F, tapers from bottom to top and has a taper surface 102 corresponding to the taper surface 93 of the lower body member 18. Thus as the upper body member moves downwardly with respect to the lower body member, the effective largest dimension of the combined body members and connecting bar increases. A groove 104 extends along the length of the upper body member 20 in which is held and in which moves a portion of the connecting bar 15. Shear pins 106 extend through holes 108 in the lower part of the upper body member 20, through the connecting bar 15 and into the holes 97 in the upper part of the lower body member 18. The concave member 22 is pinned to the upper body member 20 with a connecting pin 112 that extends through holes in the concave member 22 and holes in the upper body member 20.

Figure 9A:
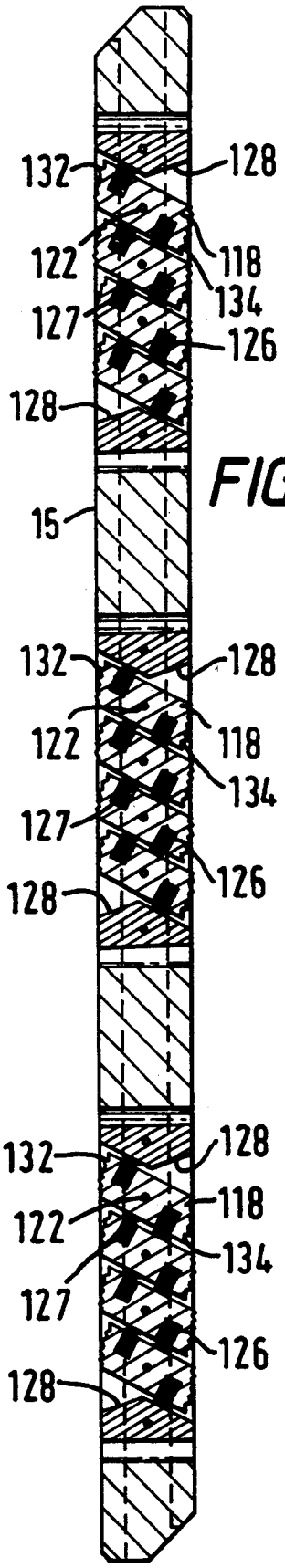
FIG. 9A is a side view of a connecting bar of the system of FIG. 1.
Figure 9B:
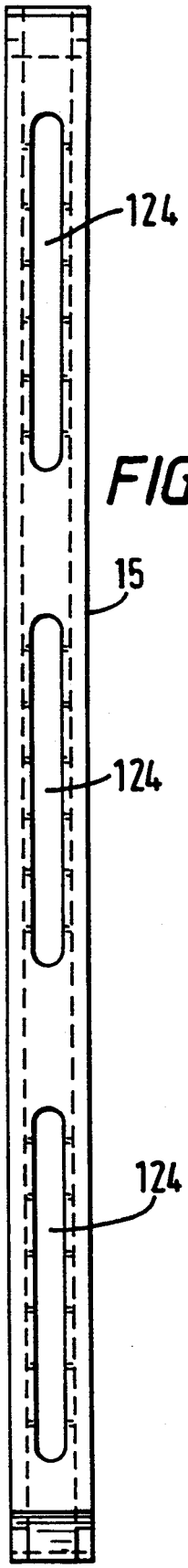
FIG. 9B is another side view of the connecting bar of FIG. 9A.
Figure 9C:
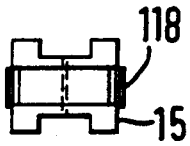
FIG. 9C is a cross-sectional view of the bar of FIG. 9A.

FIGS. 1, and 9A–9C show the connecting bar 15. In certain preferred embodiments, the bar has one or more movable pawls 118 pinioned with a center pin 122 within slots 124 in the bar 15. Springs 126 are partially disposed in spring recesses 127 in the pawls 118. Each spring is biased against an adjacent pawl or an adjacent edge 128 to insure that all the pawls in a series of pawls remain in contact and move together. Edges 128 of each slot 124 acts as a panel stop to prevent further counterclockwise (as viewed in FIG. 9A) rotation of the pawls 118. While the system 10 is run into the casing C, the upper and lower body members are pinned together with the connecting bar 15 pinned between them by the pin 106. The pin 106 extends through hole 108 in the upper body member 20 and hole 97 in the lower body member 18. When the pin 106 holding the upper and lower body members are sheared and relative movement is permitted between the upper and lower body members, the connecting bar 15 guides and controls this movement. As the movement commences, the pawls 118 rest in the slots 124. However, if an upward force is applied to the system 10, pulling the upper body member 20 upwardly, the pawl(s) 118 pivot so that toothed surfaces 132 on one side of some of the pawls engage the lower body member 18 and toothed surfaces 134 on the other side of some of the pawls engage the upper body member (some of the pawls in the middle engaging both body members) thereby preventing upward movement of the upper body member 20 with respect to the lower body member 18. Movement of the middle pawls contacting both body members also forces the two body members apart. This renders the system 10 effectively anchored in the casing C with the lower body member 18 and the upper body member 20 in contact with the casing's interior surface. As shown in FIG. 9C, ends of the pawls 118 will protrude slightly from the bar 15 upon rotation of the pawls in response to an upward force so that the pawls' toothed surfaces can engage the upper and/or lower body members.

In one operation according to this invention, a system 10 according to the present invention is inserted into and through tubing which has been run into casing in a wellbore. The system 10 is at the end of a string as previously described and descends through the tubing, exiting the tubing and entering casing within the wellbore. The system is lowered to a desired point in the casing until the receptacle 12 encounters the anchor 26 and the system 10 is oriented correctly with respect to the anchor's key. Then pushing down on the system 10 shears the pin 106 (e.g. at 2000 pounds force) freeing the upper and lower body members for relative movement.

Figure 13A:
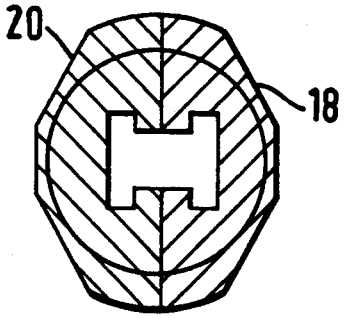
FIG. 13A is a cross-sectional view along line G—G of FIG. 3 with the connecting bar omitted.
Figure 13B:
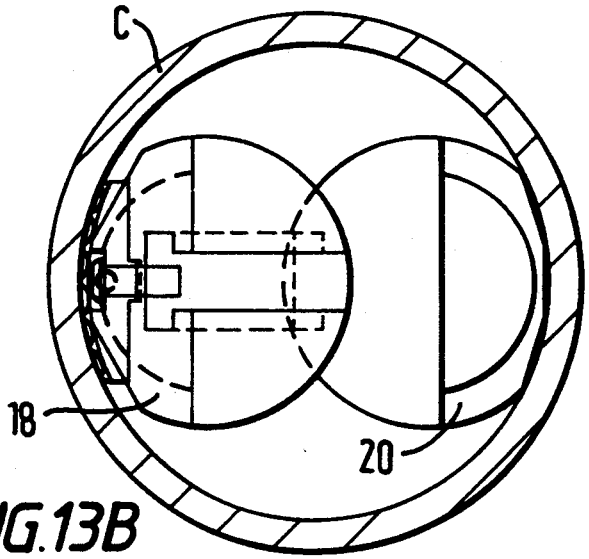
FIG. 13B is a cross-sectional view of the tool of FIG. 3 with upper and lower body members in contact with a casing's interior.
Figure 12A:
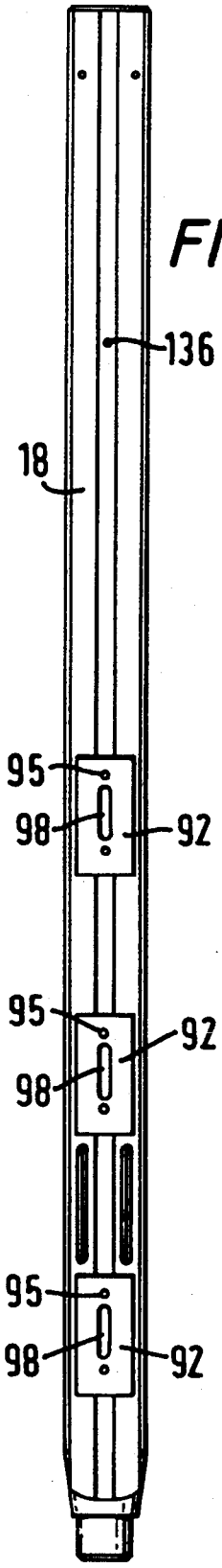
FIG. 12A is a side view of a lower body member of the system of FIG. 1.
Figure 12B:
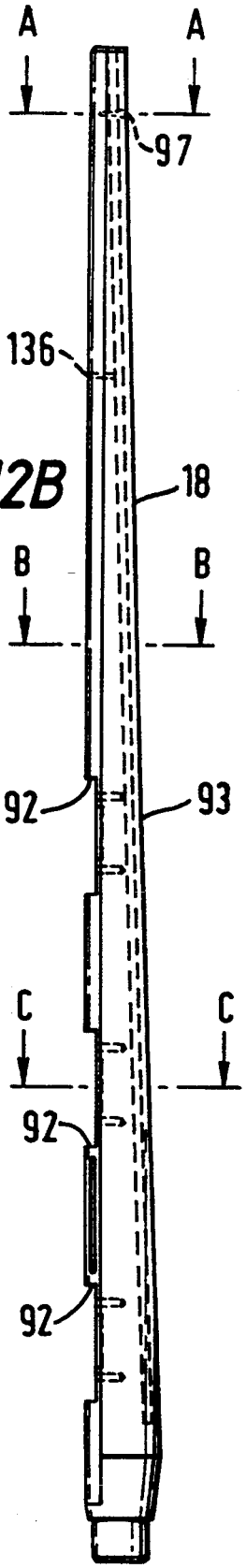
FIG. 12B is another side view of the member of FIG. 12A.
Figure 12C:
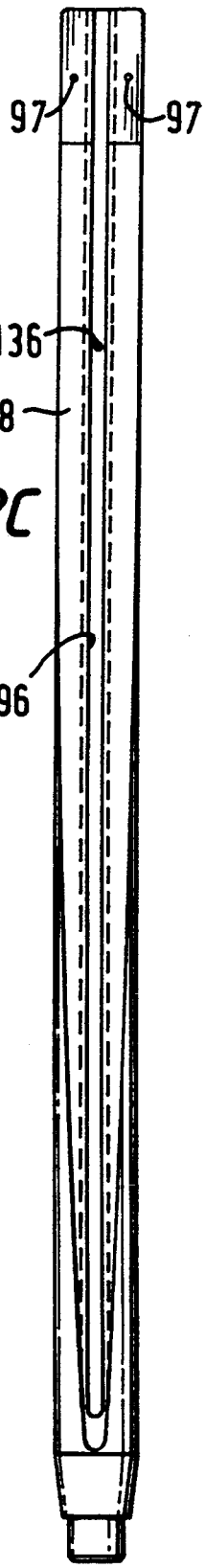
FIG. 12C is another side view of the member of FIG. 12A.

As the upper body member 20 moves downwardly with respect to the lower body member 18, the pin 115 partially disposed in a hole 136, has a protruding portion which moves into contact with a top of the connecting bar 15. The upper body member moving downwardly thus begins to force the connecting bar 15 downwardly. Once the bar 15 reaches a lower limit of its downward travel (at the end of the groove in which the bar moves or due to contact between the upper body member and the casing's interior), further force (e.g. about 500 pounds) on the upper body member 20 shears the pin 115 permitting the upper body member 20 to move further downwardly. As this is occurring, the lower body member 18 is forced sideways in the casing and eventually into frictional contact with the casing's interior (see FIG. 13B). Toothed slips on the lower body member are forced into engagement with the casing's interior with teeth oriented to inhibit upward movement of the lower body member. During movement of the upper body member, the parts of the assembly below the lower body member pivot at the neck of the splined flexion member 14 and at the notch 42 of the tube 16 so that the lower body member 18 pivots to move sideways against the casing's interior. Once the two body members are wedged into place across the casing (see FIG. 13B) (i.e., the system 10 is stabilized so it does not move up or down in the casing or rotate therein), the installation tool 24 is freed from the system 10 by pulling up on the tool 24 with sufficient force to shear the screw 55 (e.g. 12,000 to 15,000 pounds force). Upon removal of the tool 24 and the string to which it is attached, a milling tool may be inserted into the wellbore through the tubing and casing to contact the concave member 22 of the system 10 for a milling operation.

Figure 16:
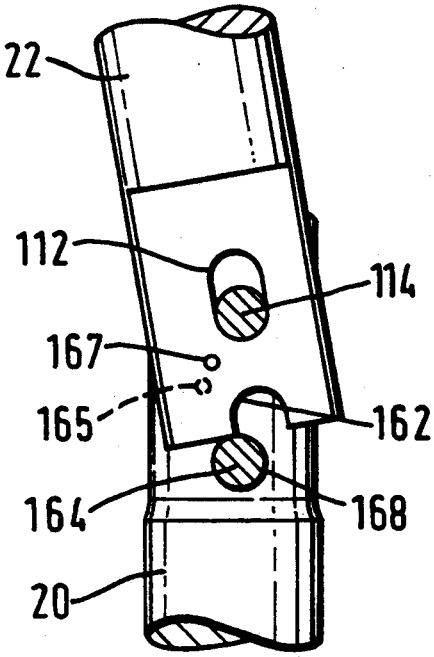
FIG. 16 is a partial side view of a toggling connection according to the present invention.
Figure 17:
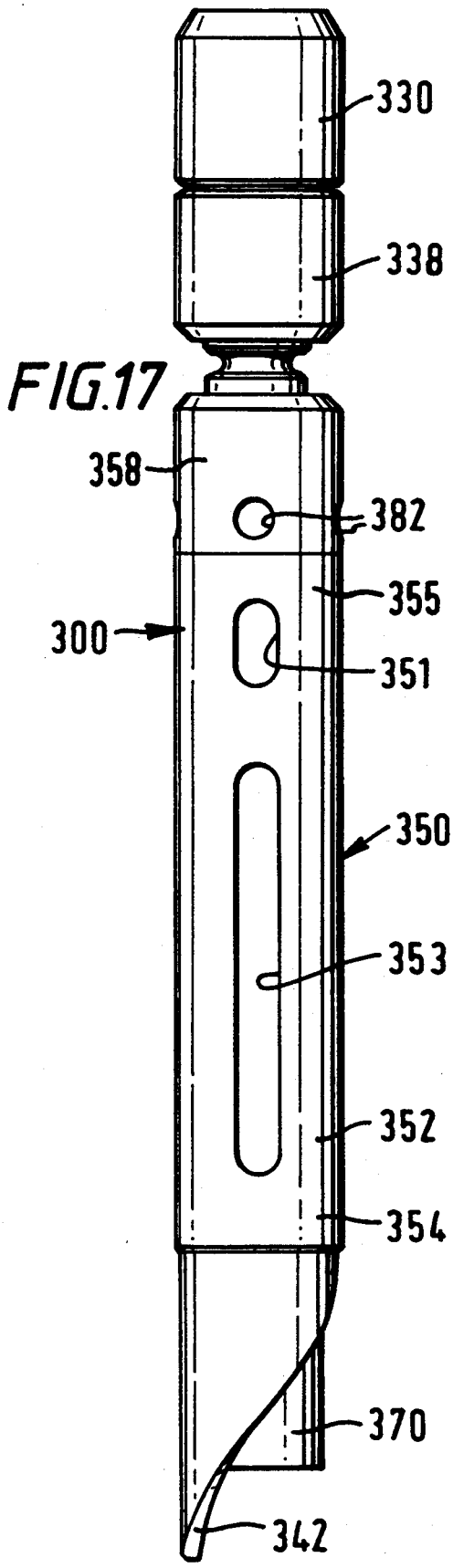
FIG. 17 is a side view of a receptacle according to the present invention.
Figure 18:
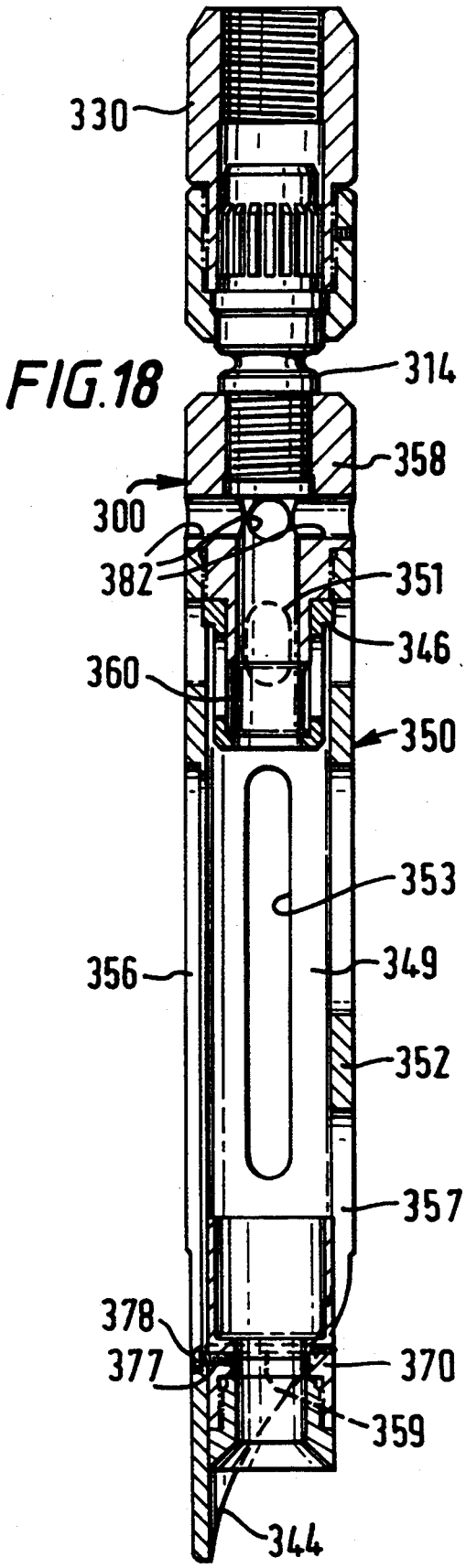
FIG. 18 is a cross-sectional view of the receptacle of FIG. 17.
Figure 19A:
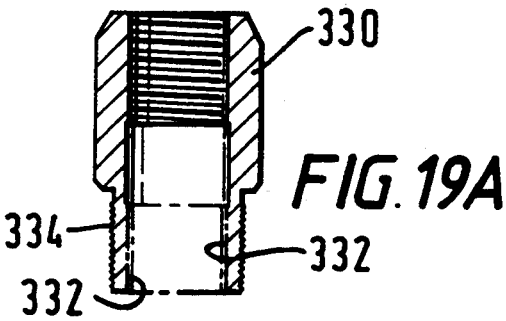
FIG. 19A–19G are side cross-sectional views of pieces of the receptacle of FIG. 17.
Figure 19G:
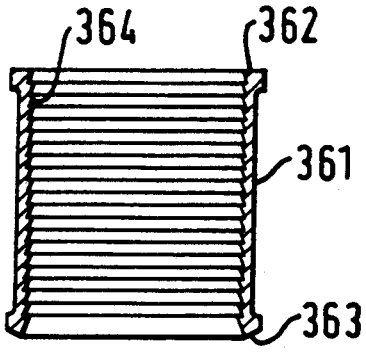
Figure 19B:
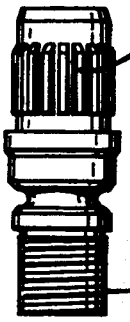
Figure 19C:
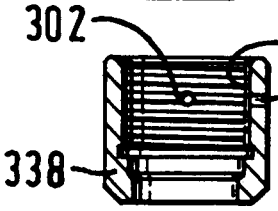
Figure 26:
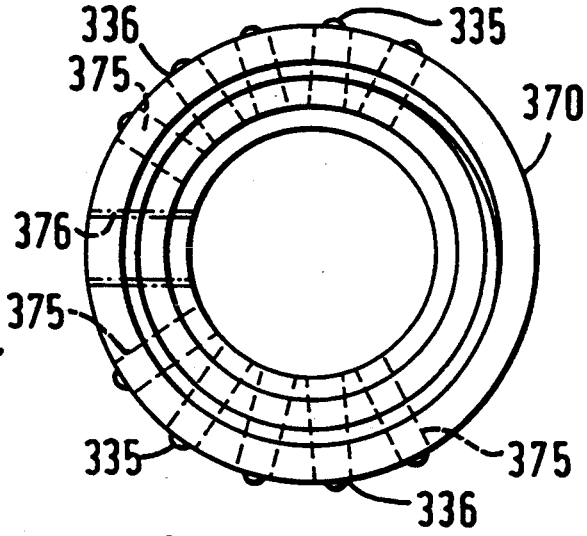
FIG. 26 is a partial cross-sectional view of the assembly of FIG. 25 through a ring of detents therein.
Figure 19D:
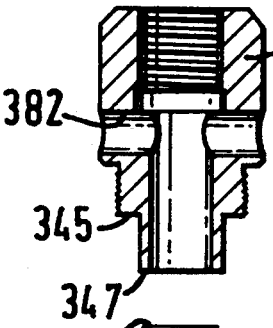
Figure 19E:
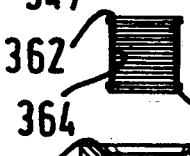

The concave member 22, as shown in FIG. 16, due to the configuration of the hole 112, is free to move upwardly (e.g. about one-half inch in certain embodiments). A toggling connection according to the present invention connects the concave member 22 and the upper body member 20. Initially it is restrained from such movement by a shear pin 133. When an upward pulling force is applied to the system 10 after the upper and lower body members have moved outwardly to wedge against the casing, the shear pin 133 (FIG. 1) is sheared (e.g. at 8,000 pounds force) freeing the concave member 22 to move and to pivot with respect to the upper body member 20. The shear pin 133 extends from a pin hole 165 in the upper body member 20 into a pin hole 167 in the concave member 22. The concave member 22 pivots on the pin 114 which extends through the hole 116 in the upper body member 20 and the hole 112 in the concave member 22. The holes 116 and 112, and 162 and 164, are configured and positioned to allow the concave member 22 to move and to pivot. As shown in FIG. 16, the upper hole 112 of the concave member 22 is elongated providing room for the pin 114 to move therein and the lower half hole 162 which initially encompasses the pin 164 is movable away from the pin 164.

FIGS. 14A–14D illustrate a whipstock system 200 according the present invention which has an inflatable anchor packer 201 with an orientation key 202; a stinger assembly 203 for co-acting with the orientation key 202 to orient the system 200; a tube 221 to interconnect the stinger assembly 203 and an interconnecting link apparatus 205 (one or more connecting links); stabilizing spring bows 204 for centering the tube 221 in a casing C; the link apparatus 205 pivotably linking together the tube 221 and a lower body member 206; the lower body member 206 movably secured to an upper body member 207 by a wedge slide 208; the wedge slide 208 having a T-member 209 movably disposed in a groove 211 in and along the top side of the lower body member 206 and a T-member 210 movably disposed in a groove 212 in and along the top side of the upper body member 207; a concave member 213 hingedly connected to the upper body member 207 with a pin 214; and a setting tool 215 secured to the concave with a shear stud 216. A shear pin 217 secures the upper body member 207 to the wedge slide 208 and a shear pin 218 secures the lower body member to the wedge slide 208.

Figure 14A:
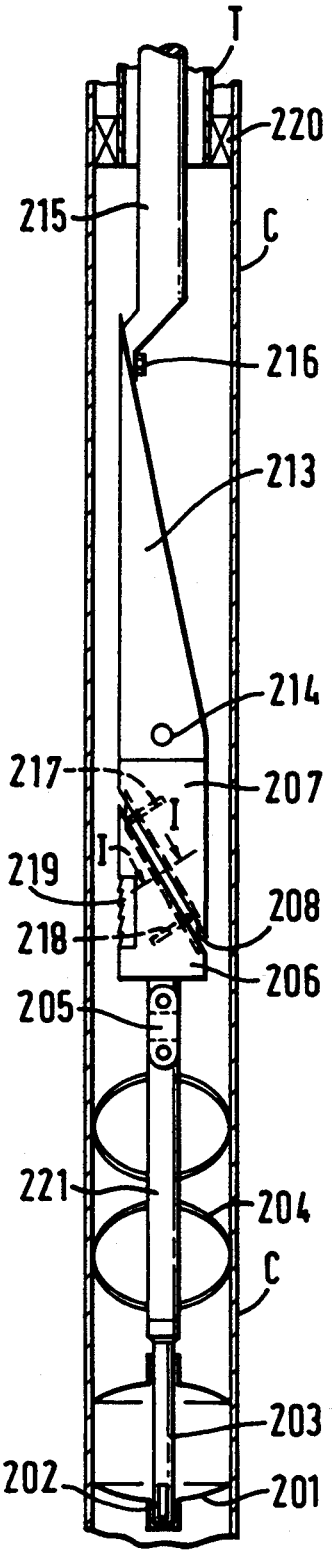
FIGS. 14A–14C is a side schematic views of a system according to the present invention.
Figure 14B:
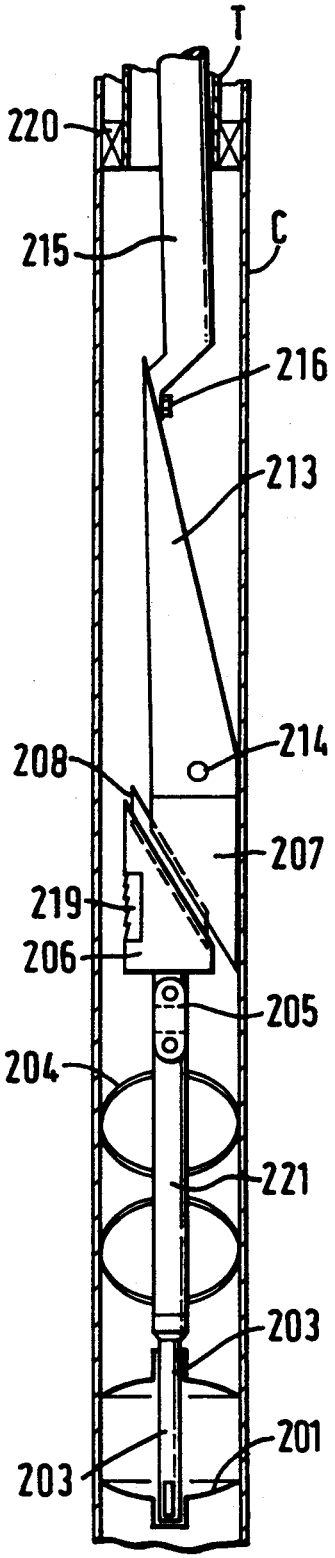
Figure 14C:
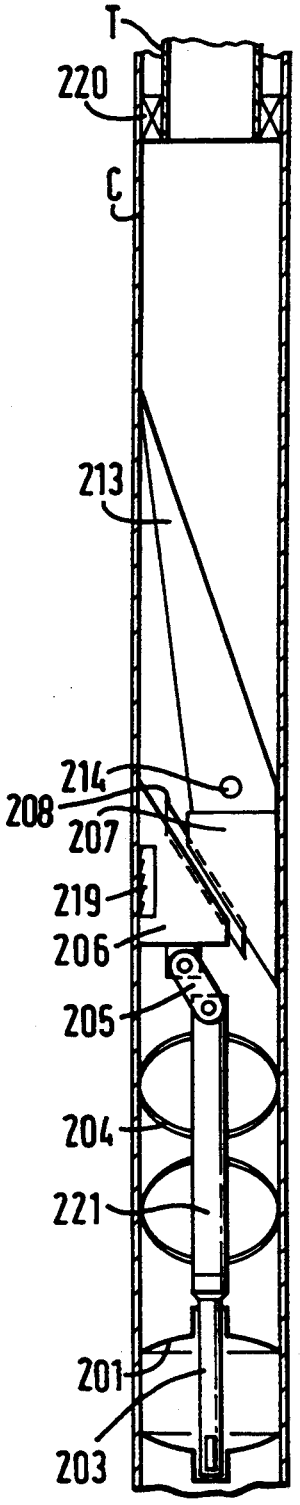
Figure 14D:
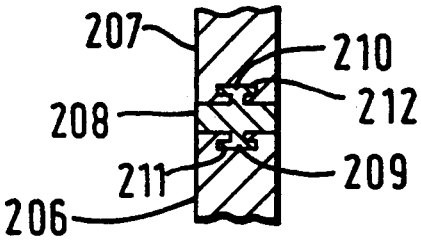
FIG. 14D is a cross-sectional view along line H—H of FIG. 14A.

As shown in FIG. 14A, the system 200 has been inserted through a casing S which has a smaller diameter than the casing C. The shear pins 217 and 218 have not been sheared so the upper and lower body members 207, 206 have not moved with respect to each other. As shown in FIG. 14B, downward force has been applied through the setting tool 215 sheafing the shear pins 217, 218 and moving the upper body member downwardly and sideways to contact the interior of the casing C. Further downward force on the setting tool 215 has pushed the lower body member against the casing's interior (FIG. 14C) and a toothed slip 219 has engaged the casing's interior. Also, the force on the shear stud 216 has been sufficient to shear it and free the setting tool 215 which, as shown in FIG. 14C, has been removed. The lower body member 206 has pivoted on the link apparatus 205 and moved to engage the casing. The concave member 213 has pivoted at the hinge pin 214 to fall back against the casing's interior. An appropriate mill or other tool can now be inserted into the casing to engage the concave member 213. A packer 220 isolates the two casings.

Figure 15:
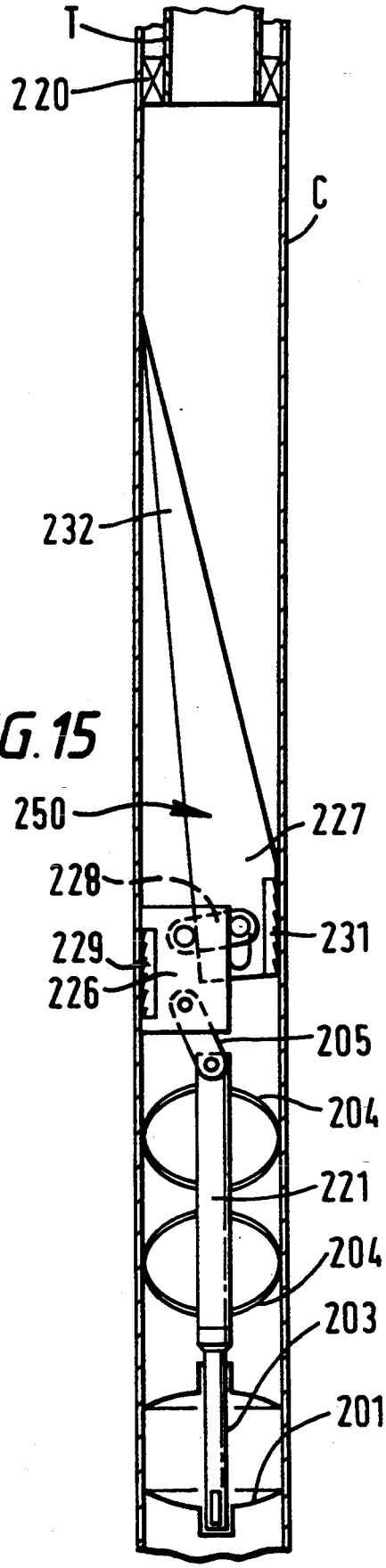
FIG. 15 is a side schematic view of a system according to the present invention.

FIG. 15 illustrates a system 250 according to the present invention which is similar to that of FIG. 14 and similar parts have similar numeral indicators. The link apparatus 205 (one or more connecting links) interconnects the tube 221 with a lower body member 226 having a toothed slip 229. An upper body member 227 with a toothed friction member 231 is pivotably connected to the lower body member 226 by link apparatus 228 (one or more connecting links; plural links disposed opposite each other) and a concave member 232 is formed integrally of the upper body member 227. The system 250 may include the other items shown in FIG. 14A and operates in a similar manner with the link apparatus 228 serving to control and guide upper and lower body member movement.

FIGS. 17–28 show an orientation assembly 300 according to the present invention which has a locking nut 330 (like the locking nut 30) and a splined flexion member 314 (like the splined flexion member 14). The locking nut 330 has internal female splines 332 into which move and are positioned male splines 316 of the splined flexion member 314. Lower outer threads 334 on the locking nut 330 threadedly engage inner threads 336 on a lower nut 338 to secure the splined flexion member 314 to the locking nut 330. One or more set screws (not shown) extend through holes 302 in the lower nut 338 to secure it to the locking nut 330.

A receptacle assembly 350 according to the present invention includes a receptacle nut 358; a receptacle 352; an upper locking assembly 360; and a lower alignment assembly 370.

The receptacle 352 has an upper fluid exit hole 351 and two side fluid exit holes 353 through which fluid in the receptacle 352 may exit as another member (e.g. part of a wellbore anchor) enters a lower end 354 of the receptacle 352 and pushes fluid out as it moves from the lower end 354 toward an upper end 355 of the receptacle 352. A hole 382 (like the ports 82) permits fluid to exit from the receptacle nut 358. A screw slot 356 accommodates a screw as described below and a key slot 357 accommodates an anchor guide key as described below. A groove 359 receives one or more detent members as described below. The receptacle 352 has dual opposed guide surfaces 342 and 344 on a nose 340.

The lower alignment assembly 370 (see FIG. 22) is releasably and movably positioned in a central longitudinal channel 349 of the receptacle 352. The lower alignment assembly: facilitates entry of another member, e.g. a stinger of a wellbore anchor, into the receptacle 352; facilitates proper alignment of the stinger (or other member) with respect to the receptacle, thereby facilitating proper alignment of a tool, device or apparatus connected to the orientation assembly 300; facilitates movement of the stinger (or other member) and a portion of the anchor (or other member) within the receptacle 352; and enhances stability of the anchor (or other member) within the receptacle 352 both during movement and at a point at which the stinger, anchor, or other member has moved to contact the upper locking assembly 360 (or some other upper part of the receptacle 352 in embodiments not employing an upper locking assembly 360).

The lower alignment assembly 370 (see FIGS. 22–28) has a body 371 with an upper hollow cylindrical portion 372 having an internal shoulder 373; one or more holes 374 through which detents 375 extend; a hole 376 in which a portion of a screw 377 is threadedly engaged, the screw 377 having a screwhead 378; an initial locking split ring 379 with two-way threads 381 (see FIG. 28); with a top 382 that abuts an inner shoulder 383 of the body 371; and a lower guide 384 with exterior threads 385 which engage interior threads 386 of the body 371 and a shoulder 387 that abuts a lower shoulder 388 of the body 371; the guide 384 having an inwardly tapered lip 389 to facilitate reception of another member in the lower alignment assembly 370.

Figure 27:
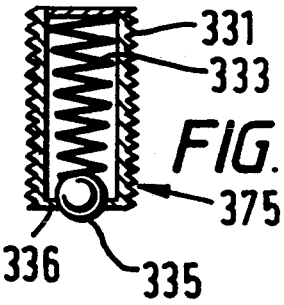
FIG. 27 is a side cross-sectional view of one of the detents of the assembly of FIG. 26.
Figure 19F:
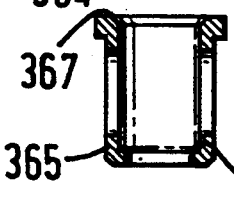

FIG. 27 shows a detent 375 with a body 331 and a spring 333 therein which urges a detent ball 335 exteriorly of the body 331 through a hole 336 (which is not large enough for the ball to escape). In one embodiment ten detents (e.g. see FIG. 26) are used and the force of the springs of all them must be overcome to free the lower alignment assembly for movement with respect to the receptacle. Preferably the balls project into a groove from which they can be forced out with sufficient force. In one embodiment the balls are one eighth of an inch in diameter and the groove is rectangular with a depth (each side's extend) of 0.050 inches and a width (bottom extent between sides) of 0.19 inches. In one embodiment with ten detents the force applied by each is about 120 pounds and the total force to be overcome is about 1200 pounds to free the lower alignment assembly for movement. In certain preferred embodiments this force is between about a total of 500 pounds to about 1500 pounds. In one embodiment the upper hollow cylindrical portion 372 of the body 371 is about four inches; and for other embodiments is, preferably, between about two and about twelve inches long.

Figure 28:
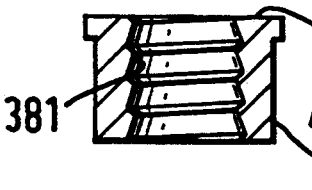
FIG. 28 is an enlargement of the lock ting of FIG. 23 showing two-way locking/releasing threads on an interior thereof.
Figure 20:
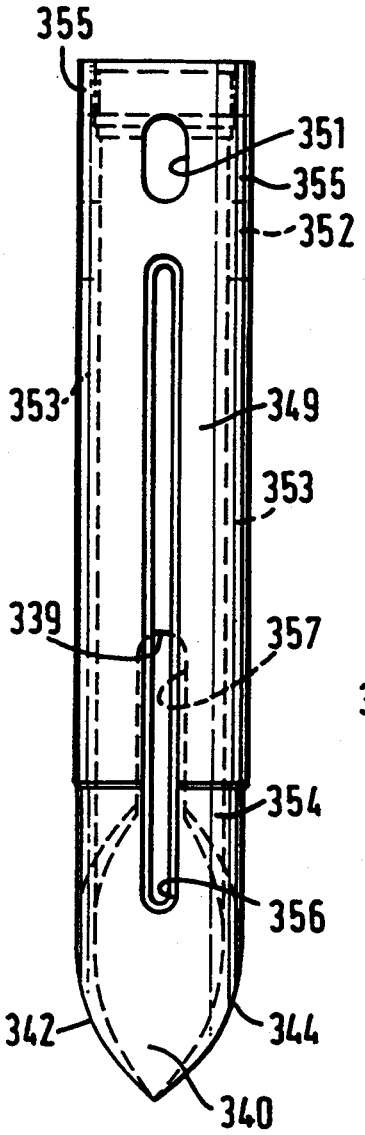
FIG. 20 is a front view of a portion of the receptacle of FIG. 17.
Figure 21:
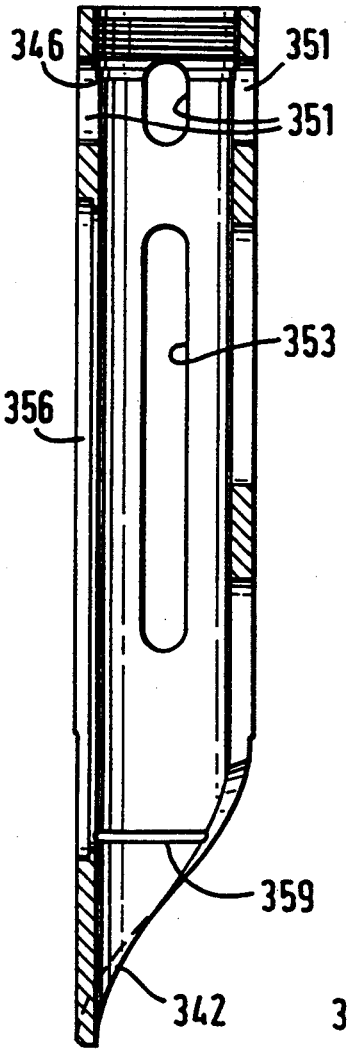
FIG. 21 is a side cross-sectional view of a receptacle body of the receptacle of FIG. 17.
Figure 22:
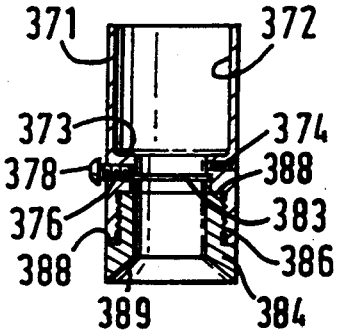
FIG. 22 is a side cross-sectional view of a lower locking assembly according to the present invention and as used in the receptacle of FIG. 17.
Figure 23:
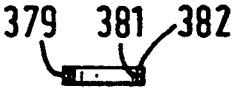
FIG. 23 is a side cross-sectional view of a lock ring of the assembly of FIG. 22.
Figure 24:
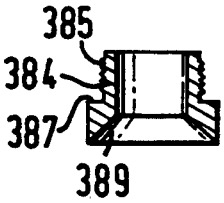
FIG. 24 is a side cross-sectional view of a lower guide of the assembly of FIG. 22.
Figure 25:
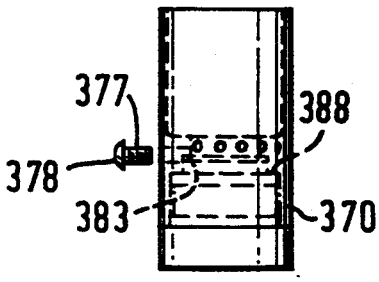
FIG. 25 is a side view, partially in cross-section, of the assembly of FIG. 22.

FIG. 28 is an enlarged view of the initial locking split ring 379 and shows the two-way threads 381.

The upper locking assembly 360 has a split locking ring 361 (see FIGS. 19E, 19G) with a top 362, a bottom 363, and interior locking one-way threads 364. The split locking ring 361 is held in place by a housing 365 so that the top 362 of the split locking ring 361 abuts an end 347 of the receptacle nut 358 and a lower shoulder 366 of the housing 365. The threads 364 are positioned to contact a member inserted into the split locking ring 361. In embodiments in which the inserted member has exterior threads or other protrusions, the threads 364 are configured and positioned to co-act with the threads or other protrusions to lock the inserted member in the upper locking assembly. In certain embodiments in which non-releasable locking of the upper locking assembly is desired, threads 364 may be two way releasing threads; they may be eliminated; or they may be configured to lock with a certain force that may be overcome by pulling up on the receptacle 352. The housing 365 has an upper shoulder 367 which is secured against a shoulder 346 of the receptacle 352 and against a shoulder 345 of the receptacle nut 358.

In certain preferred embodiments the housing 365 and the receptacle nut 358 are configured, shaped and sized so the split lock ring is movable up and down with respect thereto some small distance, e.g. in one embodiment to a total extent of about one eighth of an inch. Such movement makes it possible for the split lock ring 361, once it has engaged a portion of another wellbore tool, to be forced downwardly due to upward force on the tool containing the split lock ring and/or due to the weight of the engaged tool pulling down on the split lock ring. Such movement increases the force of the lock ring against the engaged tool due to the co-action of an inclined surface 305 on the ring 361 moving downwardly and against a corresponding inclined surface 307 on the lower shoulder 366. Thus enhanced locking force is achieved.

Figure 29:
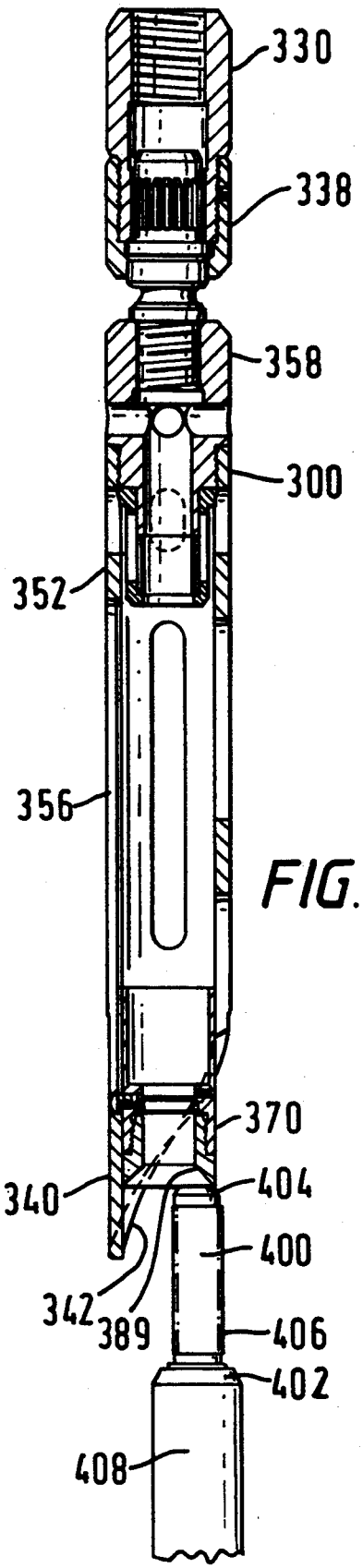
FIGS. 29–34 are side cross-sectional view showing one method of operation of tools according to the present invention.
Figure 30:
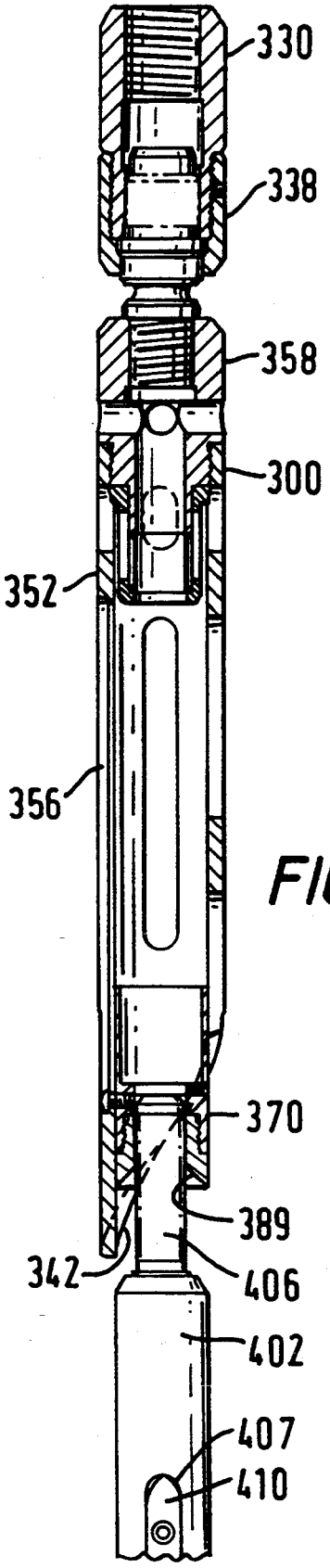

FIGS. 29–34 show one method of operation of one embodiment (300) of the present invention. As shown in FIG. 29 a stinger 400 of a wellbore anchor 402 has a tip 404 which has moved to contact the lip 389 of the lower alignment assembly 370 of the receptacle 352 of the orientation assembly 300. As shown in FIG. 30, the stinger 400 has moved further into the lower alignment assembly 370 and a portion of the stinger 400 is aligned with the receptacle 352 (central longitudinal axes of each are aligned).

Figure 31:
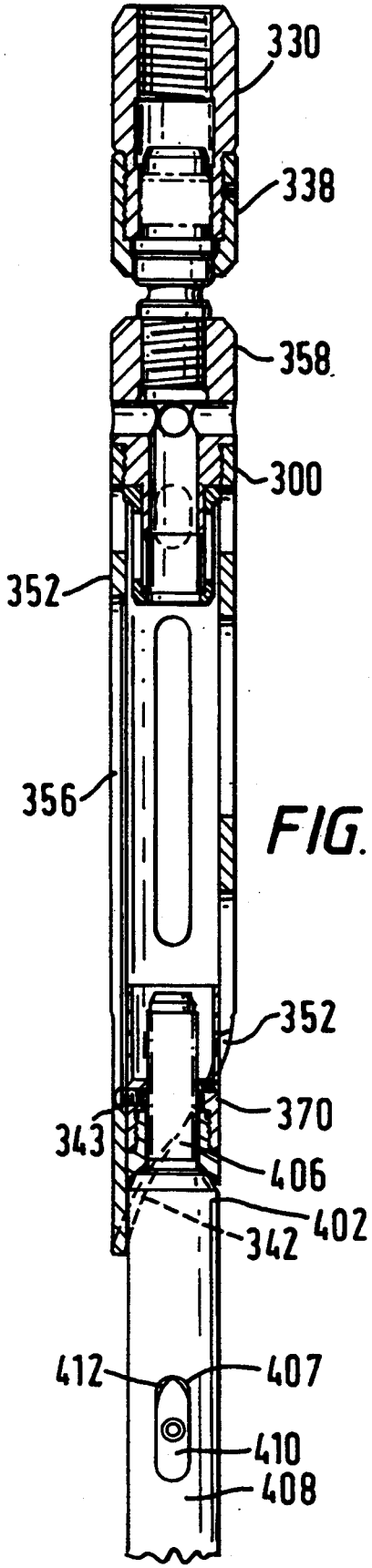

FIG. 31 illustrates further movement of the lower alignment assembly 370 in the receptacle 352 with respect to the stinger 400. Threads 381 of the initial locking split ring 379 have releasably engaged threads 406 on the exterior of the stinger 400 and the stinger 400 has rotated upwardly within the locking split ring's threads. A guide key 410 according to the present invention secured in a recess 407 of the body 408 of the anchor 402 has not yet engaged either surface 342, 344 of the nose 340 of the receptacle 352.

Figure 32:
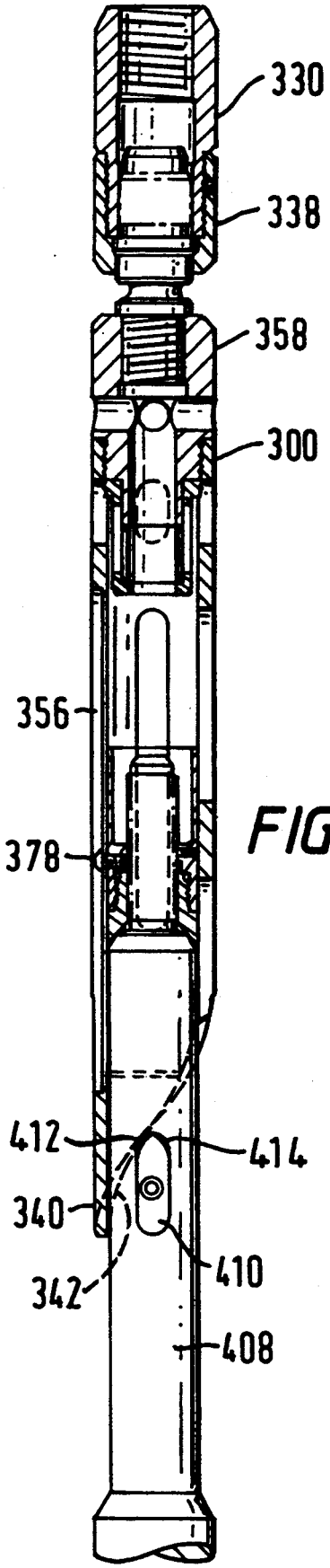

FIG. 32 shows the guide key 410 contacting a curved surface 342 of the nose 340. A surface 412 of the guide key 410 has been contacted by the surface 342 of the receptacle 352 and the receptacle 352, urged by the stationary key, has moved along the surface 412 of the key 410 and commenced to correctly orient itself with respect to the anchor 402. The force of the orientation assembly against the anchor 402 has overcome the combined spring forces of springs of the detents 375, releasing them from the groove 359 of the receptacle 352, thereby releasing the lower alignment assembly 370 for movement with respect to the receptacle 352 and permitting the receptacle 352 to move down over the anchor 402. The screw 377 with its head 378 moves in the slot 356, stabilizing and limiting the movement of the lower alignment assembly. Initially screw 377 abuts a shoulder 343 of the slot 356 to prevent the lower alignment assembly from falling out from the receptacle 352.

Figure 33:
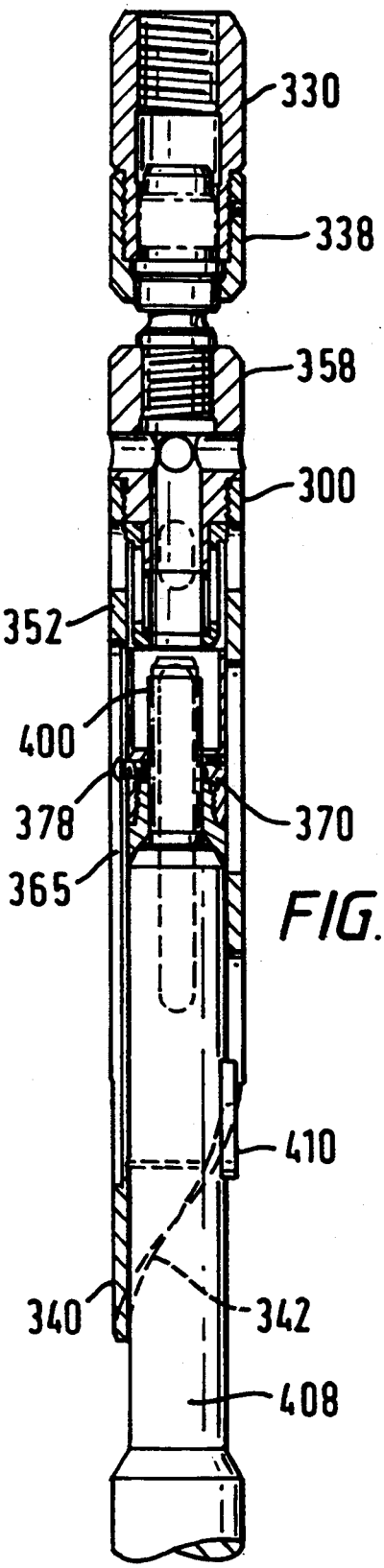

FIG. 33 shows further movement of the orientation assembly 300 with respect to the stinger 400 and anchor 402.

Figure 34:
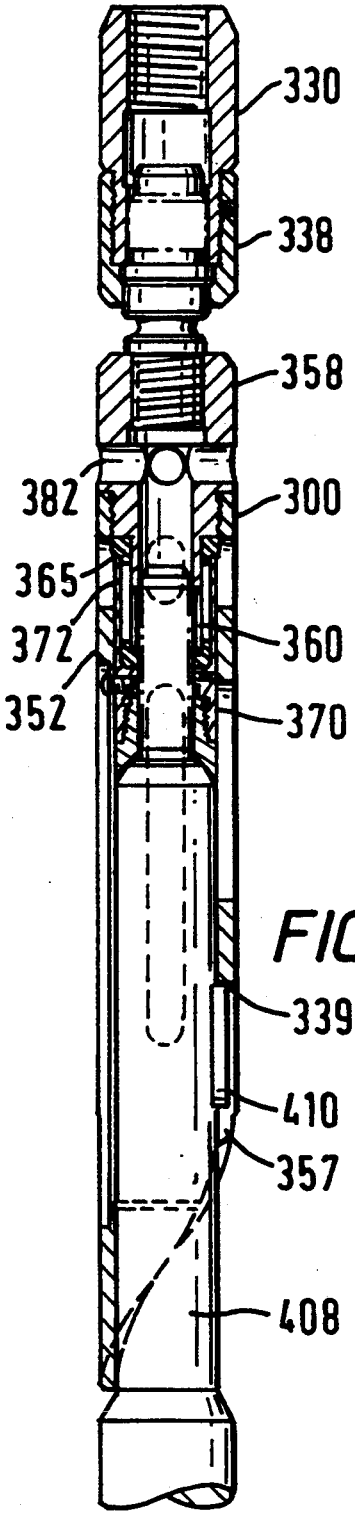

FIG. 34 illustrates final locking of the stinger 400 by the threads 364 of the split locking ring 361, of the upper locking assembly 360; and abutment of the guide key 410 against an inner edge 339 of the key slot 357. The upper hollow cylindrical portion 372 of the body 371 of the lower alignment assembly 370 is now disposed between an exterior of the housing 365 of the upper locking assembly and an interior of the receptacle 352, further stabilizing the receptacle 352 and anchor 402. For added stability the various parts are sized and configured so that the upper hollow cylindrical portion 372 contacts (in certain preferred embodiments with minimal frictional force) the housing 365 and the receptacle's interior.

Figure 35A:
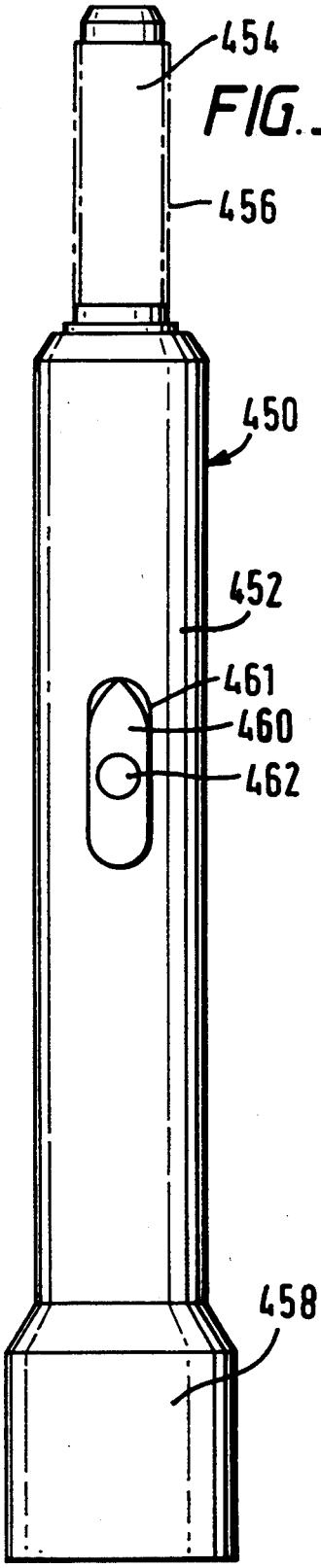
FIG. 35A is a side view of a wellbore anchor according to the present invention according to a design of the present invention.
Figure 35B:
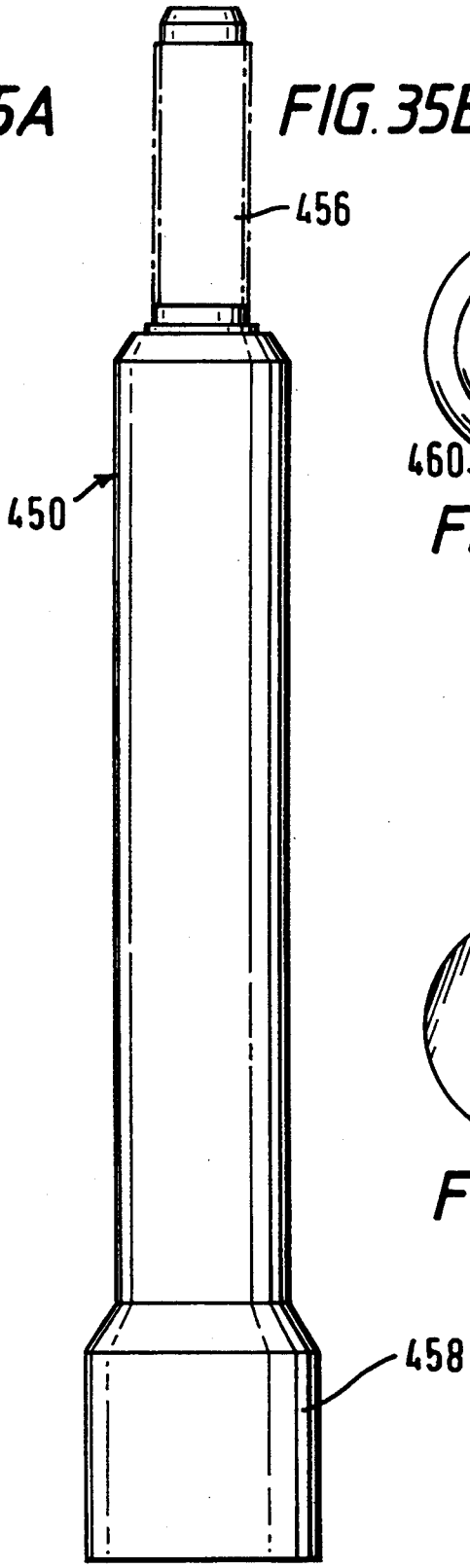
FIG. 35B is a view of the side of the anchor opposite the side shown in FIG. 35A.
Figure 35C:
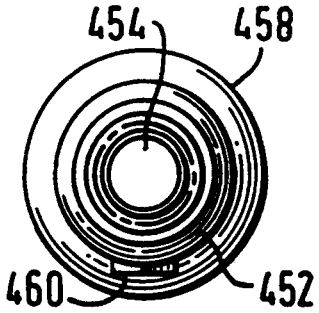
FIG. 35C is a top view of the anchor of FIG. 35A.
Figure 35D:
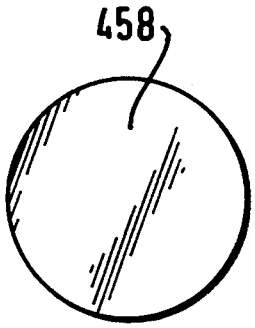
FIG. 35D is a bottom view of the anchor of FIG. 35A.
Figure 36A:
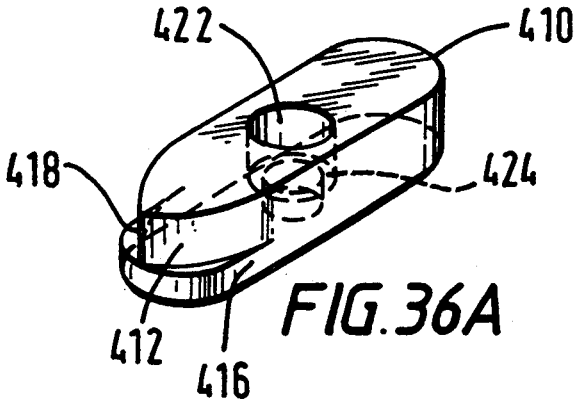
FIG. 36A is a perspective view of a guide key according to the present invention.
Figure 36B:
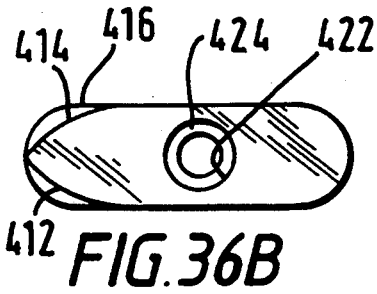
FIG. 36B is a top view of the key of FIG. 36A.
Figure 36C:
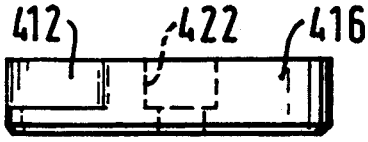
FIG. 36C is a side view of the key of FIG. 36A (the other side being a mirror image of this side.)
Figure 36D:
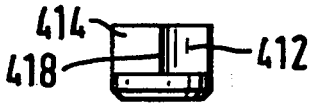
FIG. 36D is a front end view of the key of FIG. 36A.
Figure 36E:
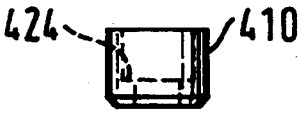
FIG. 36E is a back end view of the key of FIG. 36A.
Figure 36F:
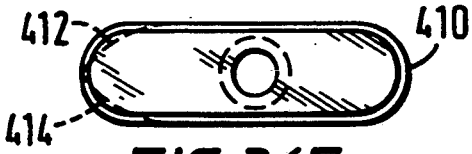
FIG. 36F is a bottom view of the key of FIG. 36A. Deletion of dotted lines in FIGS. 36A, C, E and F presents an exterior design of the key.

FIGS. 35A–D show wellbore anchor 450 according to the present invention with a guide key 460 according to the present invention, according to designs of the present invention. The wellbore anchor 450 has a tubular body 452, a tubular stinger 454 with exterior threads 456 therearound. Item 458 represents schematically anchoring apparatus for anchoring the anchor in a wellbore or tubular member (e.g. but not limited to an anchor packer, or mechanical anchoring device). A bolt 462 secures the guide key 460 in a recess 461 of the anchor body 452. FIG. 35B is a view of the side of the anchor 450 opposite the side with the guide key 460. FIG. 35C is an end view of the top of the anchor 450; and FIG. 35D is an end view of the bottom of the anchor 450.

Figure 37A:
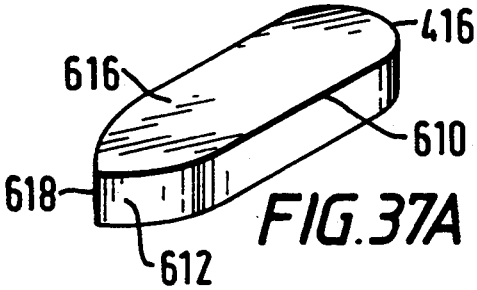
FIG. 37A is a perspective view of a guide key according to the present invention.
Figure 37B:
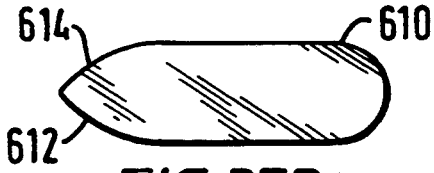
FIG. 37B is a top view of the key of FIG. 37A.
Figure 37D:
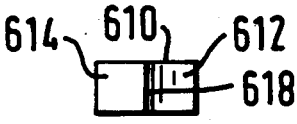
FIG. 37D is a front end view of the key of FIG. 37A.
Figure 37C:
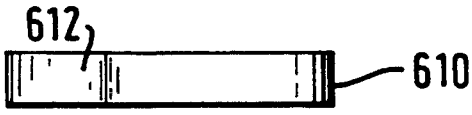
FIG. 37C is a side view of the key of FIG. 37A (the other side being a mirror image of this side.)
Figure 37E:
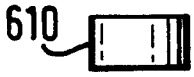
FIG. 37E is a back end view of the key of FIG. 37A.
Figure 37F:
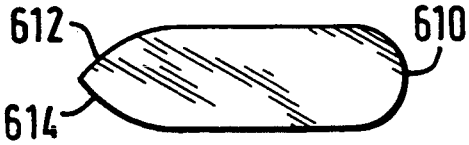
FIG. 37F is a bottom view of the key of FIG. 37A.
Figure 49A:
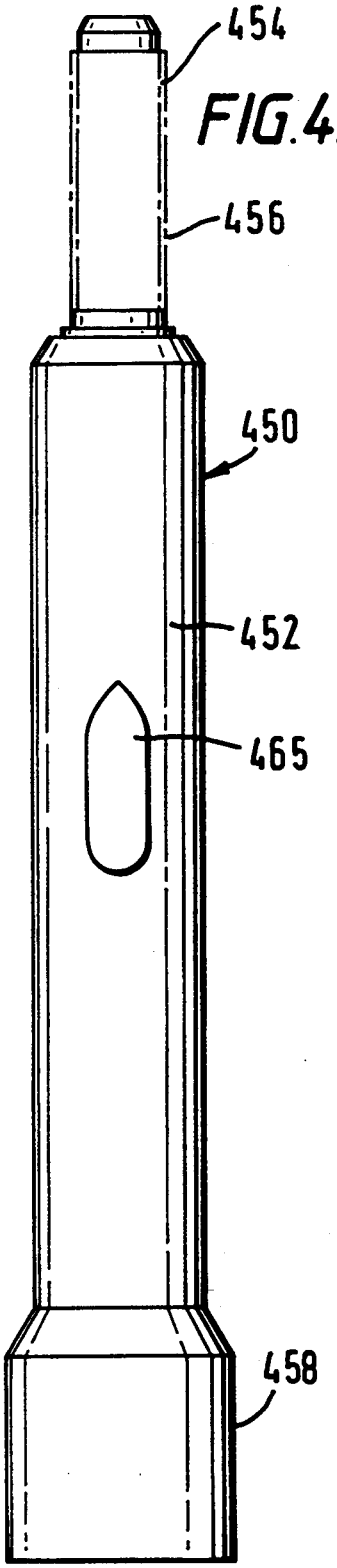
FIG. 49A is a side view of a wellbore anchor according to the present invention according to a design of the present invention.
Figure 49B:
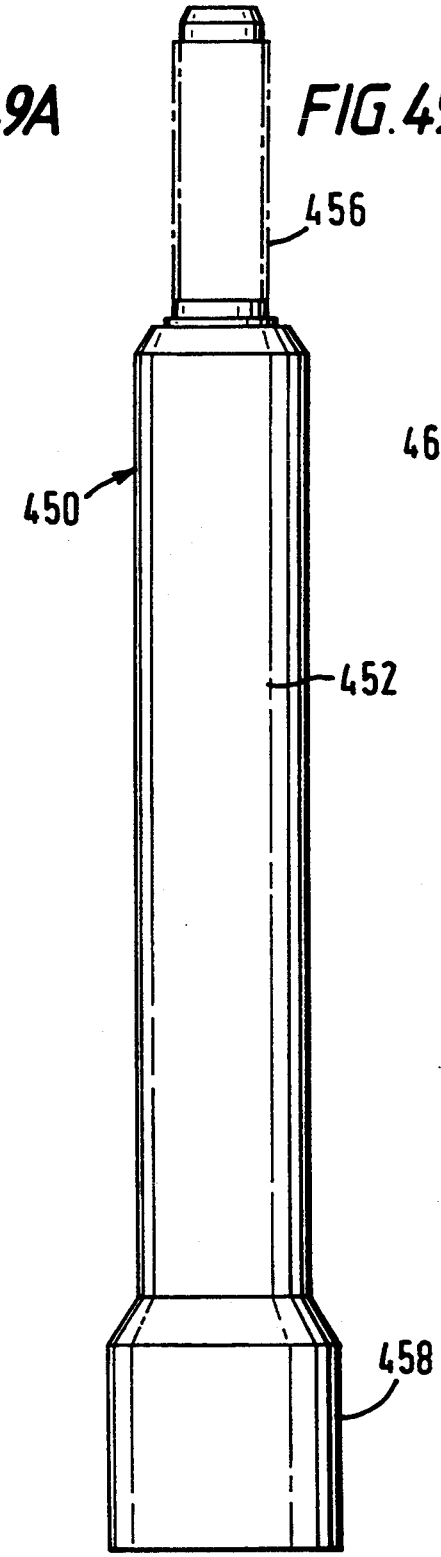
FIG. 49B is a view of the side of the anchor opposite the side shown in FIG. 49A.
Figure 49C:
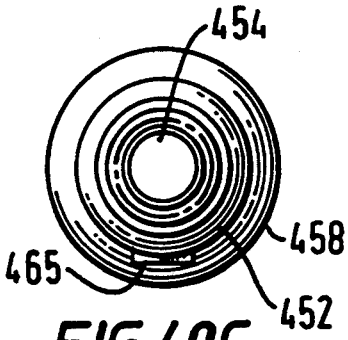
FIG. 49C is a top view of the anchor of FIG. 49A.
Figure 49D:
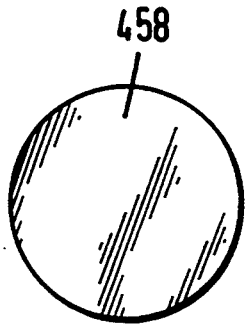
FIG. 49D is a bottom view of the anchor of FIG. 49A.

FIGS. 49A–D show the wellbore anchor 450 according to the present invention with a guide key 465 (like the key 610, FIG. 37A) according to the present invention, according to designs of the present invention. FIG. 49B is a view of the side of the anchor opposite the side with the guide key 465. FIG. 49C is an end view of the top of the anchor; and FIG. 49D is an end view of the bottom of the anchor.

FIGS. 36A–37F show guide keys according to the present invention according to designs of the present invention.

FIGS. 36A–F show the guide key 410 with a base 416, contact surfaces 412 and 414 which meet along the line 418, and a recessed hole 422 with an inner shoulder 424 through which a bolt or other securement is disposed to attach the guide key 410 to another member (e.g. the anchor body 452 of the anchor 450). Preferably the surfaces 412 and 414 are configured, shaped, sized, and positioned so that corresponding surfaces on another tool or member (e.g. but not limited to surfaces on a nose of a receptacle of an orientation assembly) effectively contact and ride on and along the curved surfaces on the guide key. Most preferably, a sufficient portion of a key surface has a similar or the same angle of inclination (or "angle of approach") as a portion of the other member's curved surface to effect efficient and correct movement of the two items with respect to each other.

FIGS. 37A–F show the guide key 610 with a body 616, and contact surfaces 612 and 614 which meet along a line 618.

FIGS. 38–41 illustrate a support assembly according to the present invention which provides lateral support for a member or tool in a wellbore or tubular. A support assembly 450 is shown for supporting a concave 451 (like items 22 or 213) of a whipstock assembly (not shown). The support assembly 450 has a pin 452 with a first end 453 initially protruding out from a curved portion 454 of the concave member 451 and a second end 455 initially positioned within a channel 456 through the concave member 451. A hole 457 in the first end 453 of the pin 452 extends through the pin 452. A wire or cable 461 connected above the support assembly 450 (e.g. but not limited to connection to a whipstock setting tool) passes through the hole 457 and prevents a spring or springs (described below) from pushing the second end 455 of the pin 452 outwardly from the concave member 451.

Figure 38:
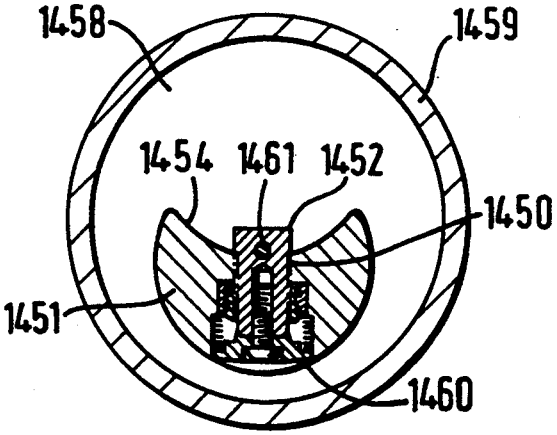
FIG. 38 is a top cross-sectional view of a support device according to the present invention in a tubular member.
Figure 39:
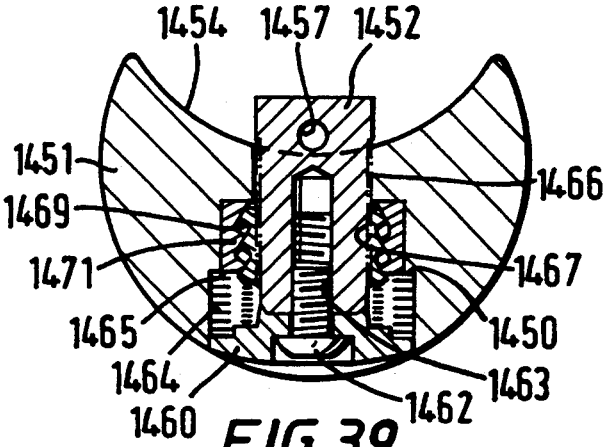
FIG. 39 is a top cross-sectional view of the support device in a concave member according to the present invention as in FIG. 38.
Figure 40:
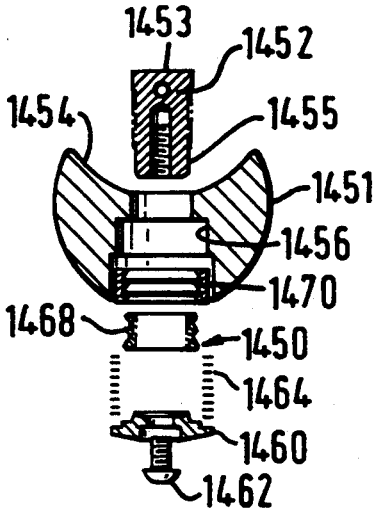
FIG. 40 is an exploded top cross-sectional view of the concave member and support device of FIG. 39.

As shown in FIG. 38 the concave member 451 is positioned in a central longitudinal channel 458 of a piece of tubular casing 459 and a cable 461 has not yet been removed from the hole 457 to activate the support assembly. A support pad 460 is secured to the second end 455 of the pin 452 with a bolt 462 which threadedly engages a hole 463 in the pin 452. Initially the pad 460 is positioned in the channel 456 of the concave 451. One or more compression springs 464 urge the pad 460 away from an inner shoulder 465 of the channel 456.

The pin 452 has one-way exterior threads 466 which permit the pin 452 to move out from the concave member 451 past corresponding one-way threads 467 on a split lock ring 468; but movement in the opposite direction, i.e., of the pin 452 back into the channel 456 of the concave member 451, is prevented by the interlocking of the threads 466 and 467. Also inclined teeth 469 on the split lock ring 468 forced against corresponding inclined teeth 471 on a stationary ring 470 prevents movement of the split lock ring 468 back into the concave member 451.

Figure 41:
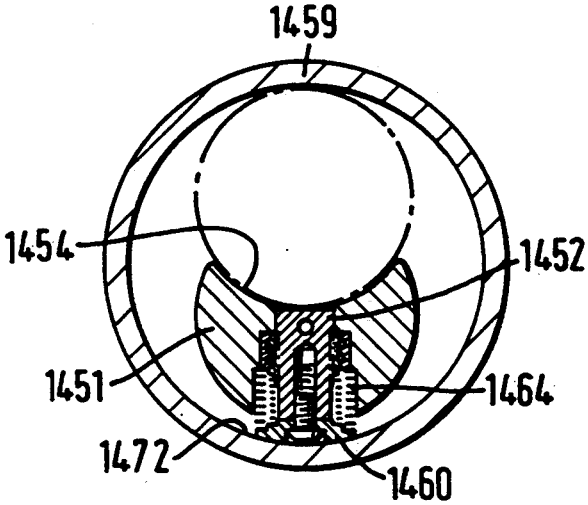
FIG. 41 is a top cross-sectional view of the tubular member, concave member, and support device of FIG. 38.

As shown in FIG. 41, the cable 461 has been removed; the support assembly 450 has been activated; and the pin 452 with the pad 460 has been pushed out from the concave 451 by the spring 464 against an inner surface 472 of the casing 459. The dotted line in FIG. 41 indicates the position of a mill (not shown) which moves down the concave face 454. The support assembly 450 prevents the force of the mill from pushing the concave 451 out of its desired position. It is within the scope of this invention to use one or more support assemblies according to this invention to support and stabilize a wellbore tool or member (e.g. but not limited to a concave of a whipstock), each with the same or a different length pin and/or each with a support pad of the same or different dimensions. In one embodiment the pin is made from steel and is cylindrical with a diameter of about one inch. In one embodiment a support pad has a front face that is generally circular with a diameter of about three inches.

Figure 44:
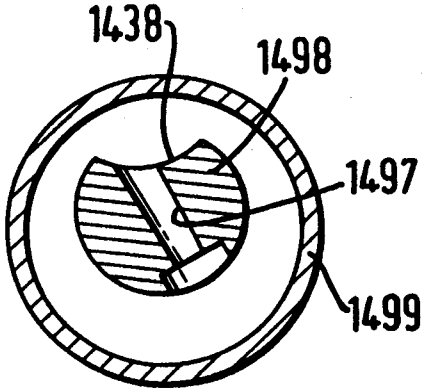
FIG. 44 is a top cross-sectional view of a concave member according to the present invention in a tubular member.
Figure 43:
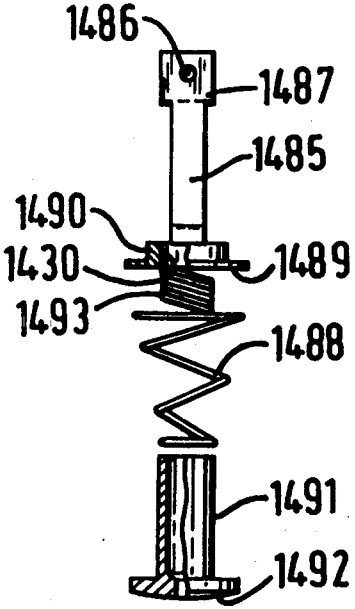
FIG. 43 is an exploded top cross-sectional view of the support device of FIG. 42.
Figure 42:
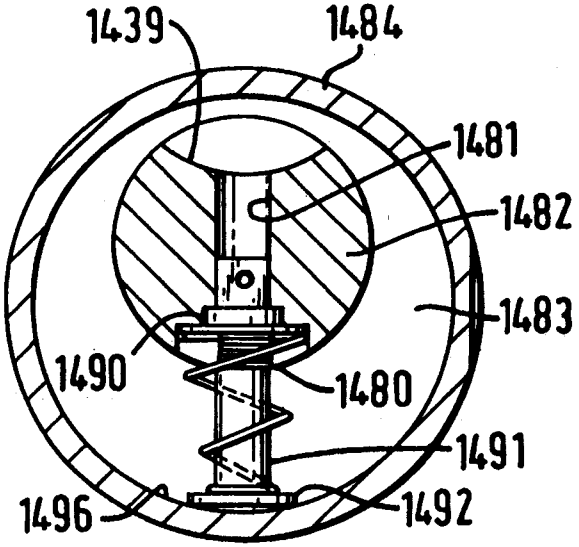
FIG. 42 is a top cross-sectional view of a support device according to the present invention with a concave member according to the present invention in a tubular member.
Figure 47:
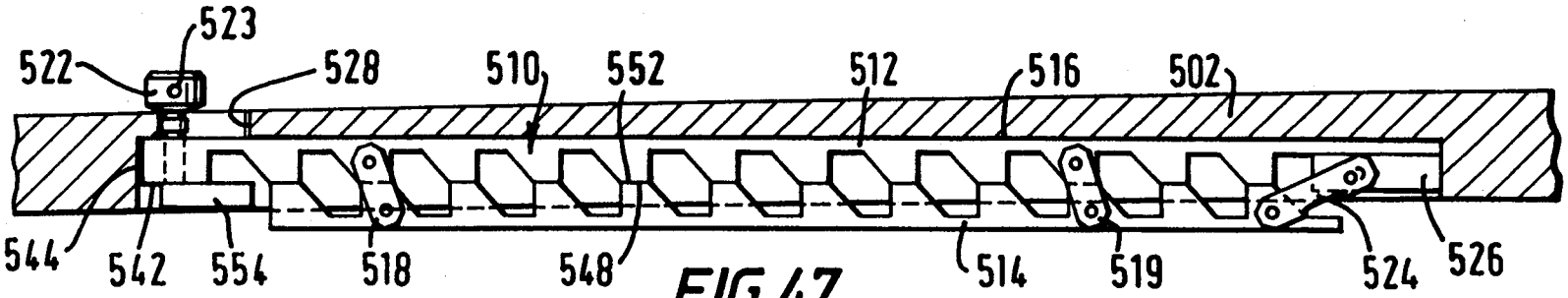

FIGS. 42–44 disclose another support assembly 480 according to the present invention in a channel 481 of a concave 482 in a central longitudinal channel 483 of a casing 484. Initially a pin 485 is held immobile in the channel 483 by a cable (not shown; like the cable 461) which extends through a hole 486 in a first end 487 of the pin 485. A compression spring 488 abuts a bottom surface 489 of a hardened flanged ring 490 made of hardened steel and urges a support pin 491 with a support face 492 outwardly from the concave 482. Initially prior to activation of the device, a stack of hardened steel washers 493 is positioned in a hole 430 of the flanged ring 490 with the pin 485 extending therethrough. The diameter of the washers is greater than the diameter of the hole 430 and the washers are disposed at an angle in the hole (falling out at the angle as shown in FIG. 43). Once the pin 485 pushes the washers from the hole and they move to a horizontal position (horizontal as shown in FIG. 42) they prevent the support pin 491 from moving back into the hole and therefore back into the concave member. A second end 494 of the pin 485 extends through a central hole 495 in the flanged ring 490. As shown in FIG. 42, after removal of the restraining cable, the pin 485 has been pushed out from the concave 482, urging the support face 492 of the support pin 491 against an interior surface 496 of the casing 484. FIG. 47 shows an alternative disposition of a channel 497 in a concave 498 in a casing 499 for a support assembly (not shown) according to the present invention to illustrate that it is within the scope of this invention to provide support assemblies which exit a concave (or other member or tool) at any desired angle. It is also within the scope of this invention to provide a plurality of support assemblies at different exit angles to support a member within a wellbore or channel of a tubular. Such assemblies, as desired, may also have pins of different length for positioning at different locations along a member or tool. As shown in FIG. 42, the channel 481 is normal to a concave face 439 of the concave 482. The angle between the channel and the concave face may be any desired angle; i.e., the support assembly may project from the tool with which it is used at any desired angle. As shown in FIG. 44, the channel 497 is not normal to a face 438 of the concave 498.

Figure 45:
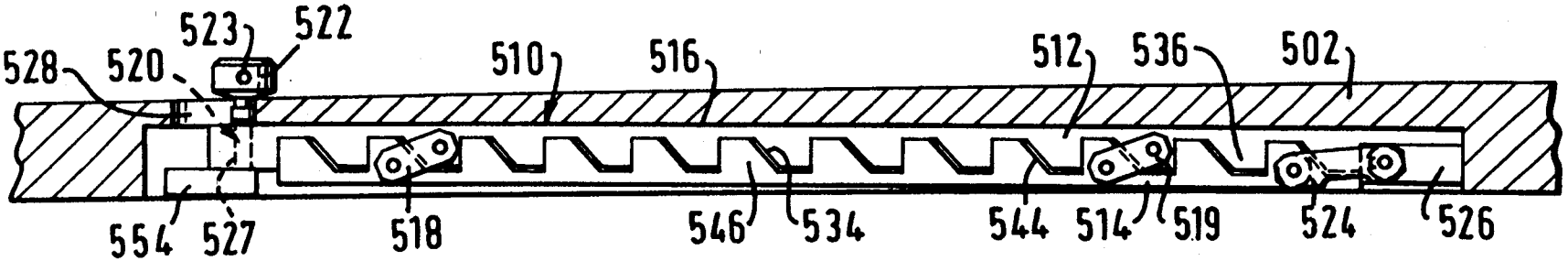
FIG. 45 is a side cross-sectional view of a concave member according to the present invention with a support device according to the present invention.

FIGS. 45–48 illustrate a support assembly 510 according to the present invention for a wellbore tool or member; e.g. but not limited to a support for a concave 502 of a whipstock assembly (not shown). Initially two toothed bars 512 and 514 are disposed in a recess 516 in the concave 502. Two pivot links 518 and 522 pivotally link the two toothed bars 512 and 514 together. A pivot link 524 links the outer toothed bar 514 to an extension member 526 of the concave 502 and prevents the toothed bar 514 from moving upward (to the left), while allowing it to move outwardly with respect to the concave. A pin 520 has a head 522 with a hole 523 therethrough and a body 526 which extends through a slot 528 in the concave 502 and into a hole 532 in the toothed bar 512. An activating wire or cable (not shown) initially is secured in or through the hole 523. As shown in FIG. 45 the pin 520 has not been moved (to the left in FIG. 48) in the slot 528 and the toothed bars 512 and 514 are in their initial position abutting each other in the recess 516 of the concave 502. Initially the pin 520 has a lower end abutting a stop member 554 (e.g. a piece of mild steel welded into the recess 516). Both the pin 520 and the top bar 512 are movable on the stop member 554.

Figure 46:
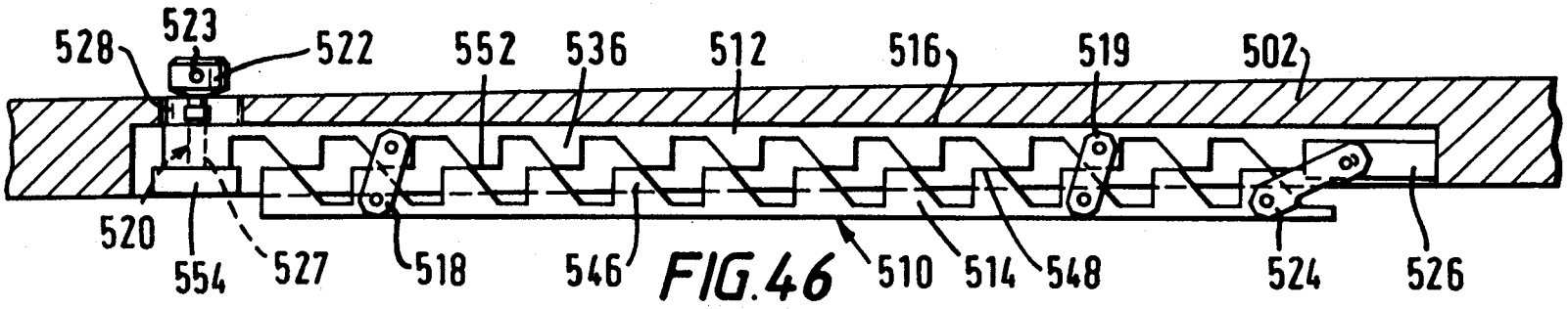
FIGS. 46 and 47 show steps in the operation of the device of FIG. 45.

As shown in FIG. 46 the pin 522 and the toothed bar 512 have been pulled by a rod or a flexible cable connected to, e.g. a whipstock setting tool (not shown); so that the pin 522 has moved to about the mid-point of the slot 528, pivoting the outer toothed bar 514 outwardly due to the force of faces 534 of teeth 536 against faces 544 of teeth 546 of the outer toothed bar 514.

Figure 48:
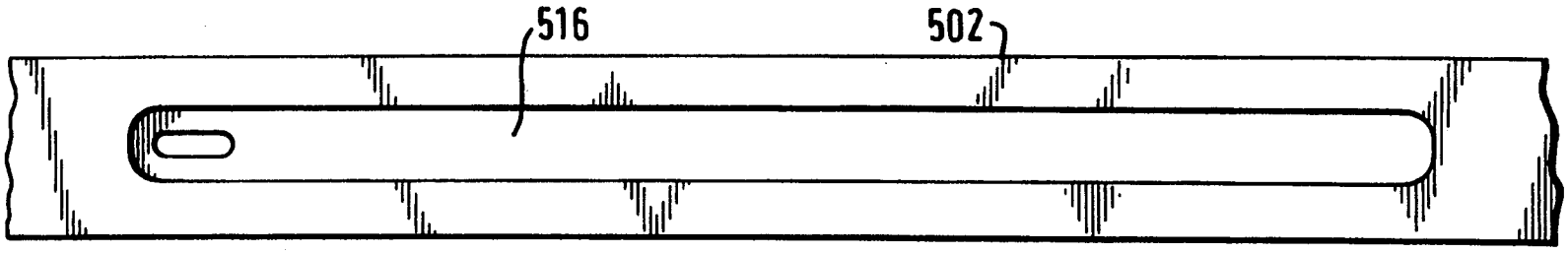
FIG. 48 is a top plan view of the concave member of FIG. 45.

As shown in FIG. 47, the inner toothed bar 512 has been pulled to its farthest upward (to the left in FIG. 47) extent by the rod or a flexible cable and an end 542 of the toothed bar 512 abuts an inner surface 544 of the recess 520. Further force of the cable on the pin 522 has sheared it and removed it. Flat end faces 552 of the teeth 536 have moved to abut and oppose flat faces 548 of the teeth 546 which prevents the toothed bar 514 from returning into the recess 520. FIG. 48 illustrates another view of the concave member 502 and its recess 516.

The outer face of the toothed bar 514 may have a pad thereon or teeth therein for contacting and engaging a casing. In one embodiment the toothed bars (like items 512 and 514) are made from steel and are about two .feet long. Due to the configuration, size, and position of the toothed bars, teeth, tooth faces, and pivot links of the support assembly 510, the bars move and are eventually disposed parallel to each other. However, it is within the scope of this invention to alter the dimensions, configuration, and disposition of the various parts to achieve a resulting angle of inclination of one bar with respect to the other. In one aspect this is useful to achieve extended contact of a bar against a wellbore or inner tubular surface when the bar is connected to a member which itself is substantially inclined with respect to a central longitudinal axis of the wellbore or tubular. As shown in FIG. 47, the bottom toothed bar 514 when extended is at an angle to the exterior surface of the concave, and at such an angle that the toothed bar's resulting position is substantially parallel to an interior surface of casing in which the device is disposed for increased and effective engagement of the casing interior.

Figure 50A:
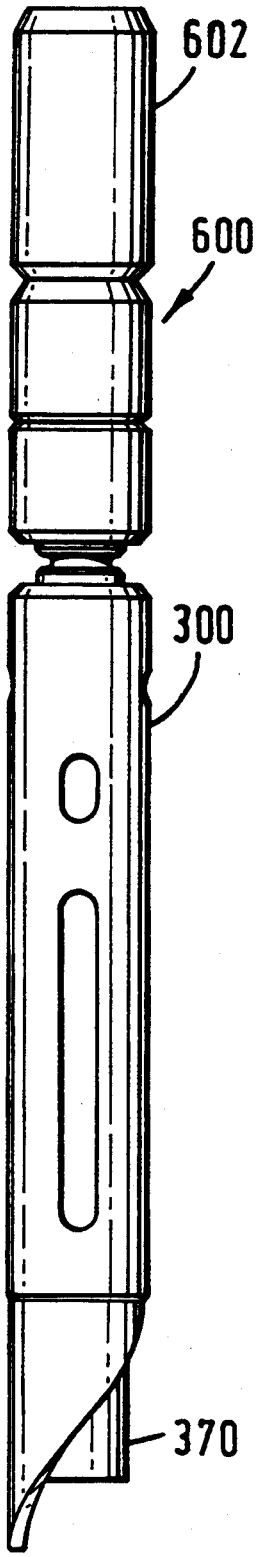
FIG. 50A is a side view of a survey tool assembly according to the present invention and FIG. 50B is a side cross-sectional view, partially schematic, of the survey tool assembly of FIG. 50A.
Figure 50B:
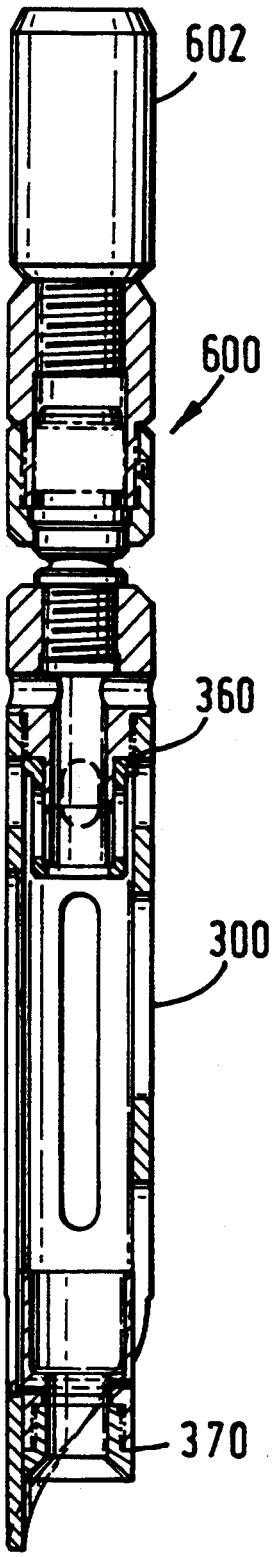

FIGS. 50A and 50B show a survey tool assembly 600 according to the present invention which has an orientation indicator tool 602 (shown schematically) (e.g. a typical tool with an orientation indicating gyroscope and associated lines, apparatuses); and an orientation assembly according to this invention as previously described, e.g. an embodiment of the orientation assembly 300. The survey tool assembly 600 has an orientation assembly such as the orientation assembly 300 with a lower alignment assembly 370 and an upper locking assembly 360 in which the upper locking assembly has a releasable upper locking split ring as previously described herein. The orientation assembly of the survey tool 600 operates as previously described herein; permitting the survey tool assembly to encounter, engage, and co-act with a wellbore anchor so that the orientation indicating tool 602 can sense and/or record the orientation direction of the wellbore anchor; then upon release of the orientation assembly from the wellbore anchor, allowing retrieval of the survey tool assembly at the surface (and/or signalling from the wellbore of the wellbore anchor's orientation).

Figure 51:
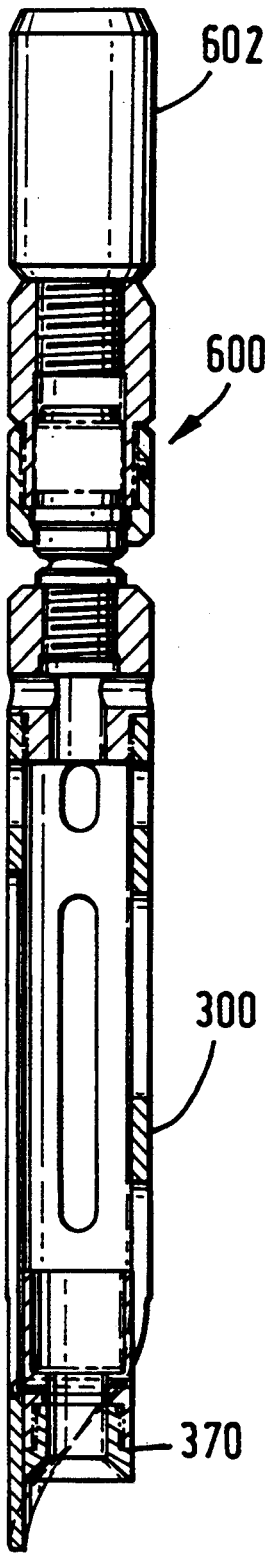
FIG. 51 is a side cross-sectional view, partially schematic, of a survey tool assembly according to the present invention.
Figure 52A:
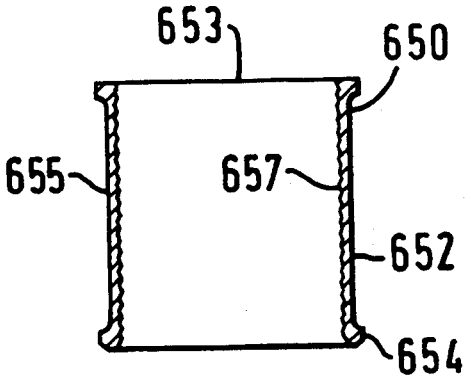
FIG. 52A is a side cross-sectional view of a split lock ring according to the present invention according to a design of the present invention.
Figure 52B:
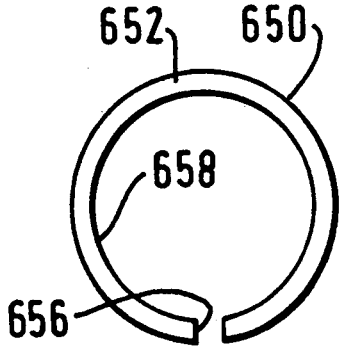
FIG. 52B is a top view of the ring of FIG. 52A.
Figure 52C:
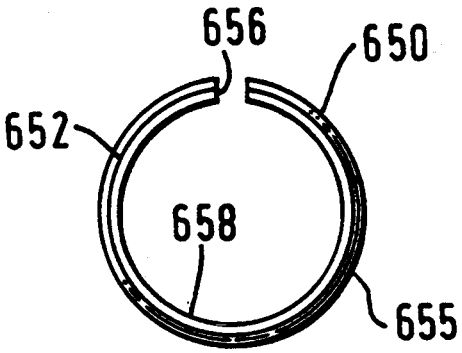
FIG. 52C is a bottom view of the ring of FIG. 52A.
Figure 52D:
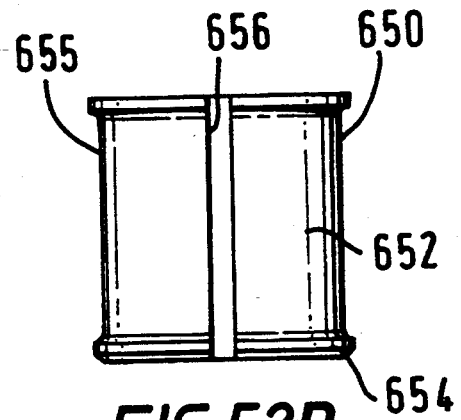
FIG. 52D is a side view of the ring of FIG. 52A.
Figure 52E:
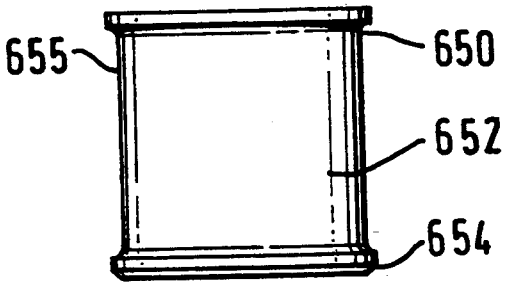
FIG. 52E is a view of the other side of the ring of FIG. 52A which is opposite the side shown in FIG. 52D.

FIG. 51 shows another embodiment of the survey tool assembly 600 which has no upper locking assembly 360 or the like.

FIGS. 52A–E illustrate a split lock ring 650 (like the split lock ring 361) according to the present invention and according to a design of the present invention. The ring 650 has a body 652, a top 653, a bottom 654, an inner wall 658, and a side wall 655. A notch 656 extends from the top of the ring to the bottom. Locking threads 657 extend around the ring's inner wall 658 (which in this aspect are permanently locking but may be configured as two-way releasing threads, see e.g. the threads in FIG. 28).

FIGS. 53A–D and 54A–C illustrate another system 700 according to the present invention for orienting and setting a whipstock in a wellbore, cased wellbore, tubing string, or other tubular member. The system 700 is shown in a casing 698. Various devices and structures which appear in previously described figures are similar to structures in the system 700; e.g. a concave member 722 is similar to the concave member 22. In the system 700 an interior rod or series of two or more interconnected rods do not move to move a block preventing system actuation and setting until correct system orientation has been achieved. Correct system orientation is achieved when an orientation receptacle 712 is correctly engaged with an anchor member (not shown), e.g. like the anchor member 26 in FIG. 1.

Referring now to FIGS. 53A–D, a whipstock system 700 according to the present invention has a lower receptacle 712 to which is secured a splined flexion member 714. The splined flexion member 714 with a neck 738 and its associated apparatuses and connections are similar to the splined flexion member 14 of FIG. 1. A connecting bar 715 interconnects a lower body member 718 and an upper body member 720. A concave member 722 is secured to a top of the upper body member 720. An installation tool 724 is releasably secured to a top of the concave member 722 and has a thrust bearing 774.

The installation tool 724 is like the tool 24 of FIG. 1 and its associated apparatus and connections are also similar to those of the tool 24. A support assembly 710 is similar to the support assembly 510 of FIG. 45.

Figures 53A, 53B, 53C, 53D:
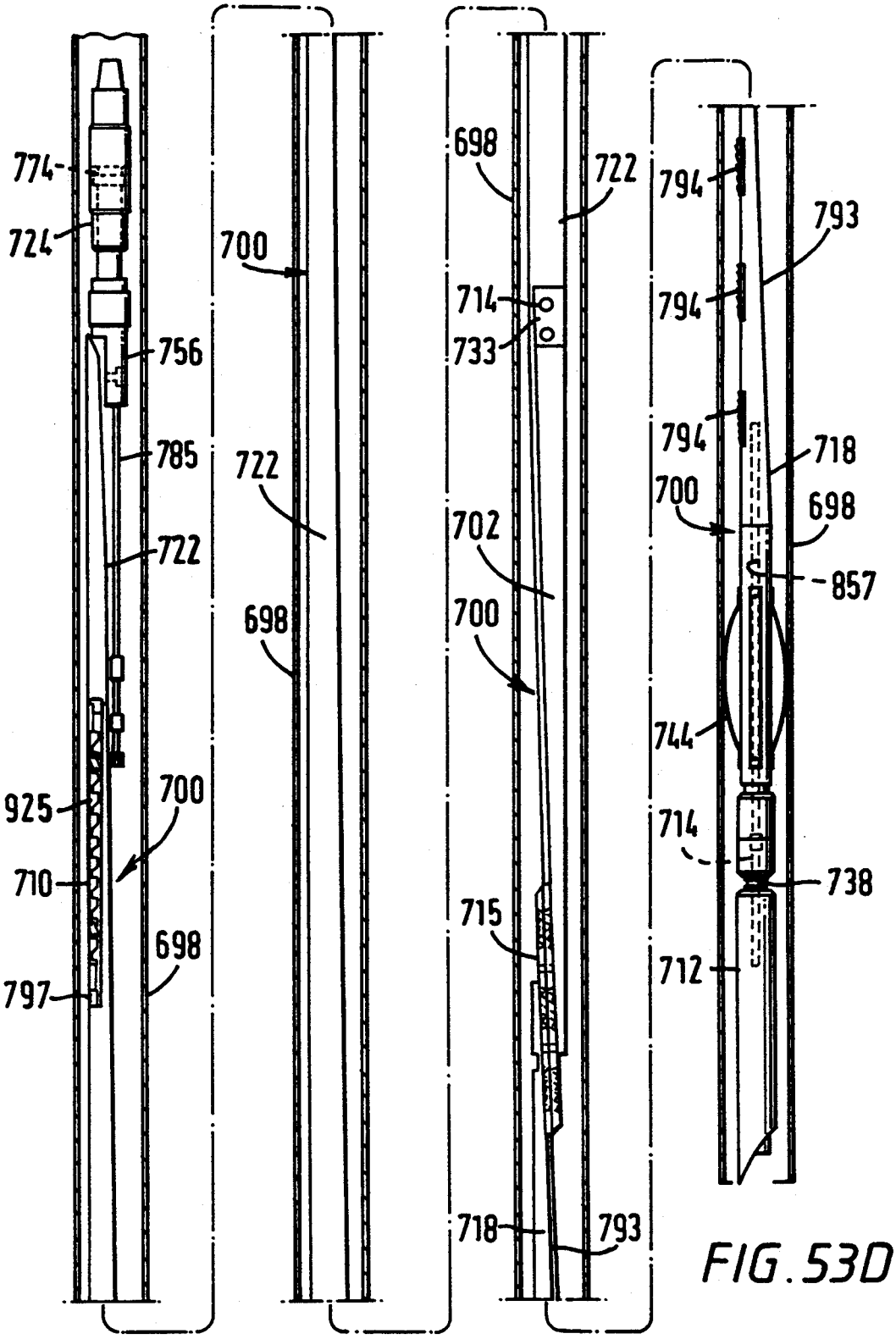
FIGS. 53A–D show a side view in cross-section of a whipstock system according to the present invention.
Figure 58:
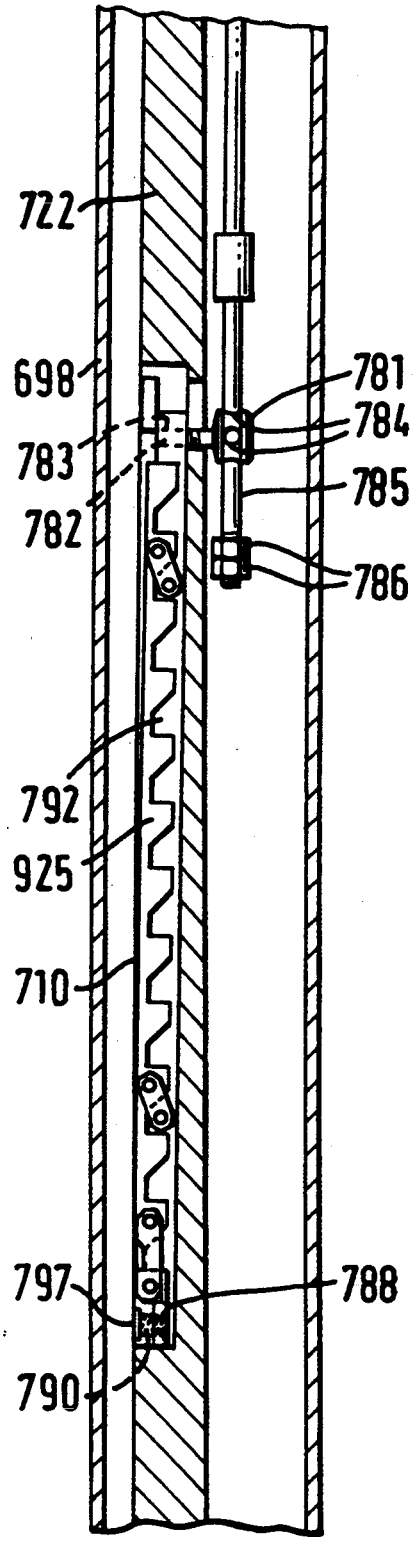
FIG. 58 shows a side view in cross-section of a support assembly of the system of FIG. 53A and the lower part of the connection apparatus of FIG. 57.
Figure 59:
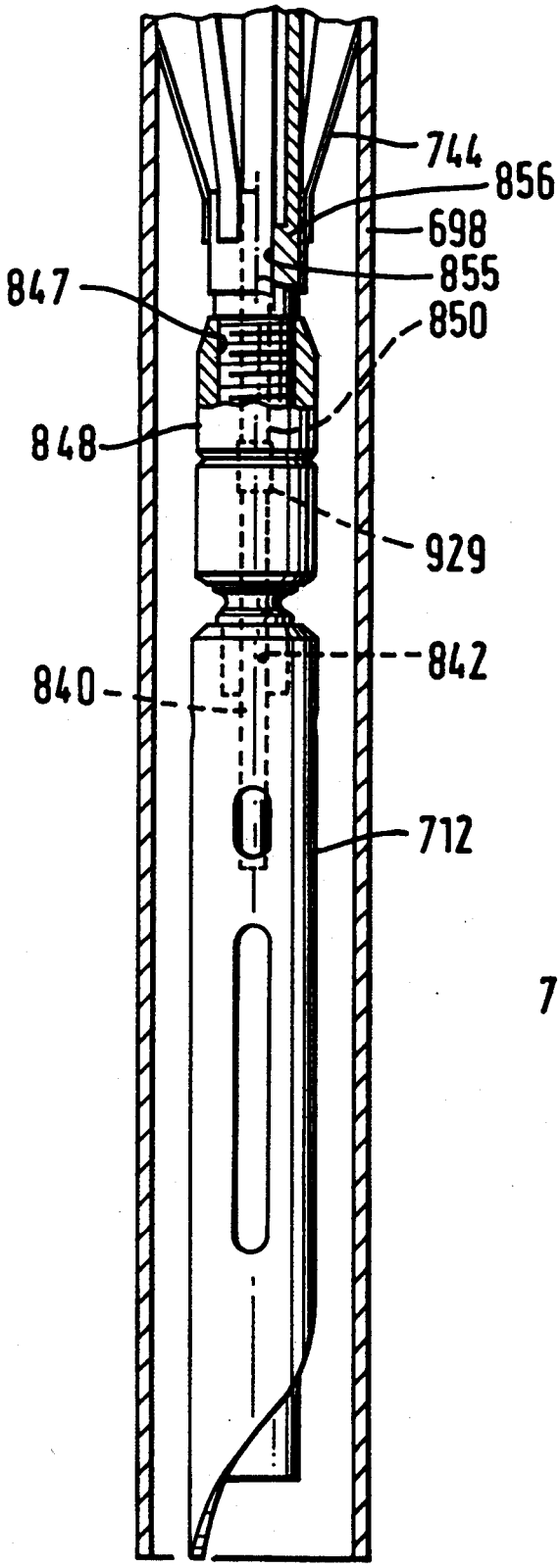
FIG. 59 shows a side view in cross-section of an orientation receptacle and associated apparatus of the system of FIG. 53A.

FIGS. 53A and 58 illustrate a support assembly 710 according to the present invention for a wellbore tool or member; e.g. but not limited to a support for a concave 722 of a whipstock assembly (as shown in FIG. 53A). The support assembly 710 is similar to the support assembly 510 of FIG. 45, but the support assembly 710 has different apparatus for freeing the installation tool from the concave member and for freeing the support assembly for outward movement with respect to the upper body member 720.

Figure 57:
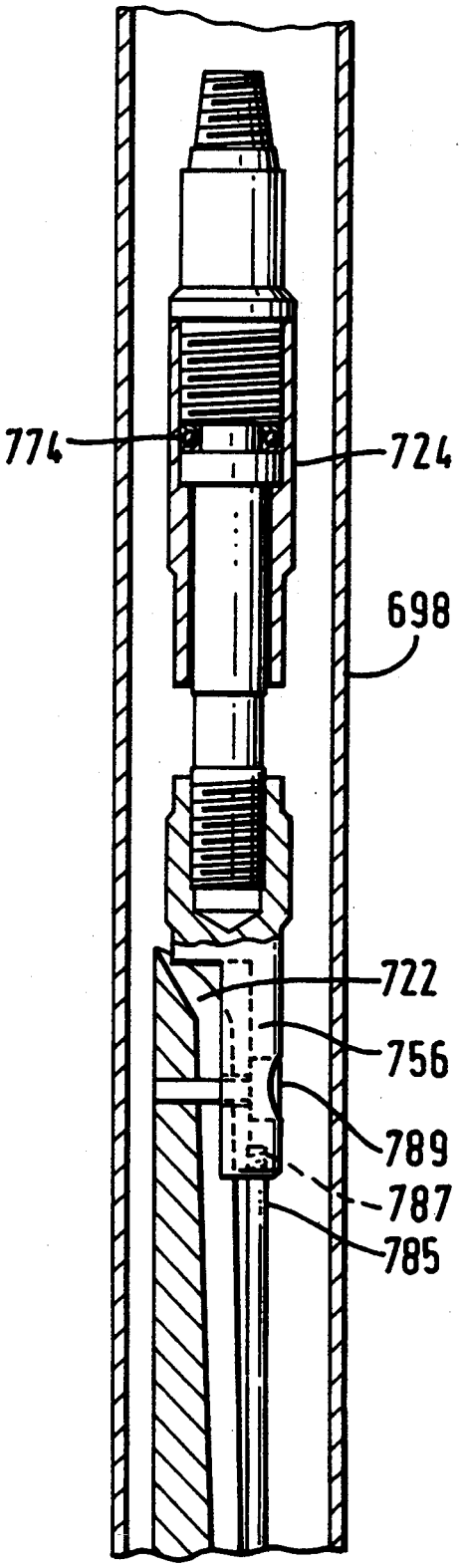
FIG. 57 is a side view in cross-section of an installation tool of the system of FIG. 53A and its interconnection with a top of a concave member on the upper body member of the system of FIG. 53A. Also shown in a top portion of connection apparatus interconnected between a top of the concave member and a support assembly (see FIG. 58) located lower on the upper body member.

Initially the installation tool 724 is releasably secured to the upper body member 720 as shown in FIG. 53A and FIG. 57. A shear bolt 781 has a neck 782 secured in a hole 783 in the upper body member 720. The shear bolt 781 has one or more holes 784 therethrough and a lower end of a rod 785 extends through a hole 784. Nuts 786 prevent the rod from exiting upwardly through the hole 784. As shown in FIG. 57, an upper end of the rod 785 is received and held in a hole 787 in a block 756 (like the block 56 of FIG. 1) which is secured to both the installation tool 724 and to the concave member 722. The neck 782 of the shear bolt 781 extends into the upper body member 720 and prevents movement of a toothed bar 792 (like the toothed bar 512 of FIG. 45) thereby preventing actuation of the support assembly 710. A shear bolt 789 secures the concave member 722 to the installation tool 724.

Figures 54A, 54B, 54C:
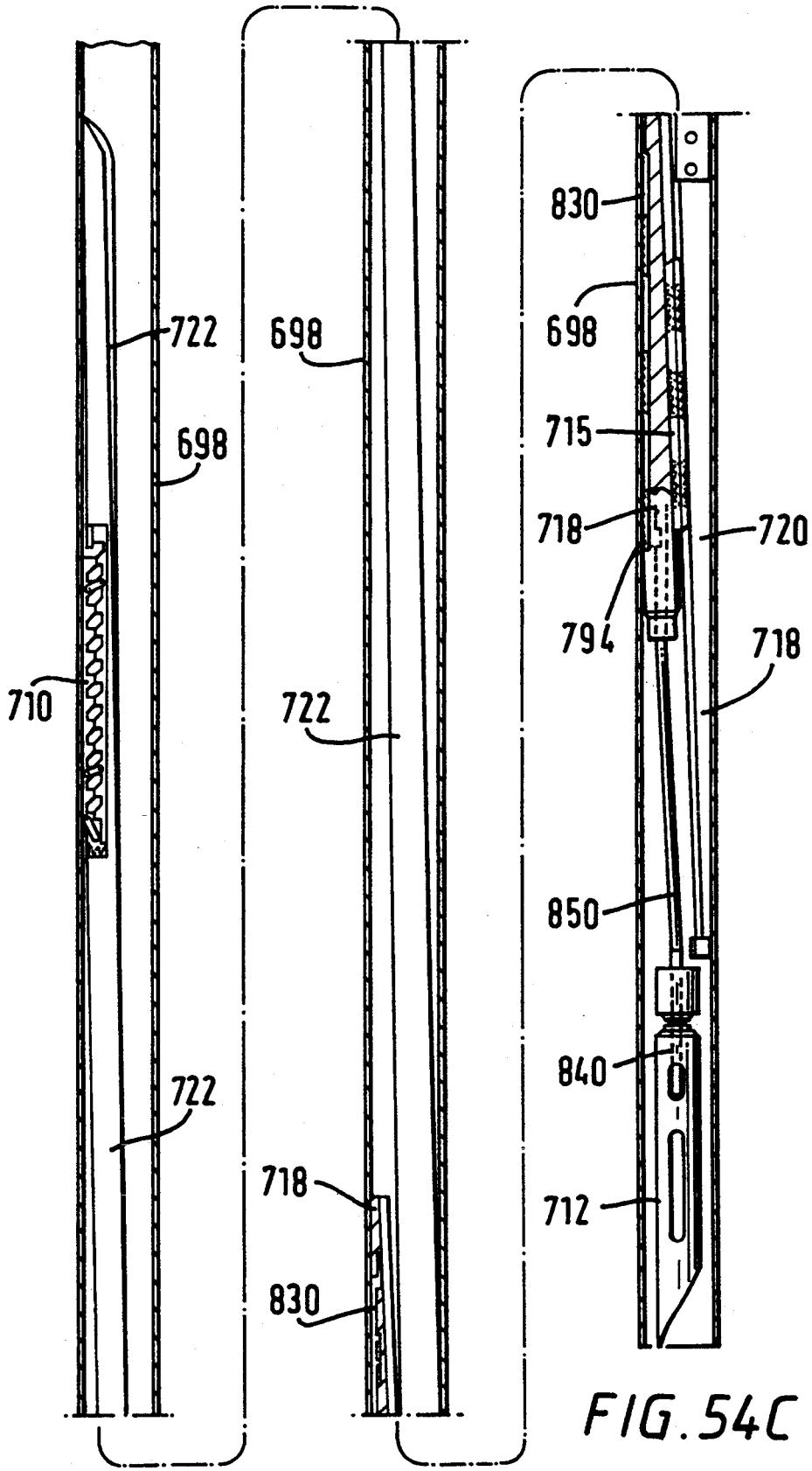
FIGS. 54A–C show the system of FIG. 53A set in a casing.

Once the system 700 is correctly oriented and set in place, upward force on the installation tool 724 shears the shear bolt 789 and results in upward movement of the rod 785 in the hole 784 of the shear bolt 781. The nuts 786 contact the shear bolt 781 and further upward force on the rod 785 shears the shear bolt 781, freeing the installation tool 724 for removal from the casing. At the same time the toothed bar 792 is freed for movement and the support assembly 710 (with other parts like those of the support assembly 510) is actuated and moves to the position against the interior of the casing 698 as shown in FIG. 54A.

To prevent a return of the toothed bar 792 to its initial position (which would result in disengagement of an outer toothed bar 925 from the interior casing wall), a blocker 788 is forced by a spring 790 to occupy space previously occupied by a lower end of the toothed bar 792, thus preventing the toothed bar 792 (see FIG. 53A) from returning to its original position (see FIG. 58). The spring 790 is biased against a plate 797 which is secured to the upper body member, e.g. by welding.

Figure 3:
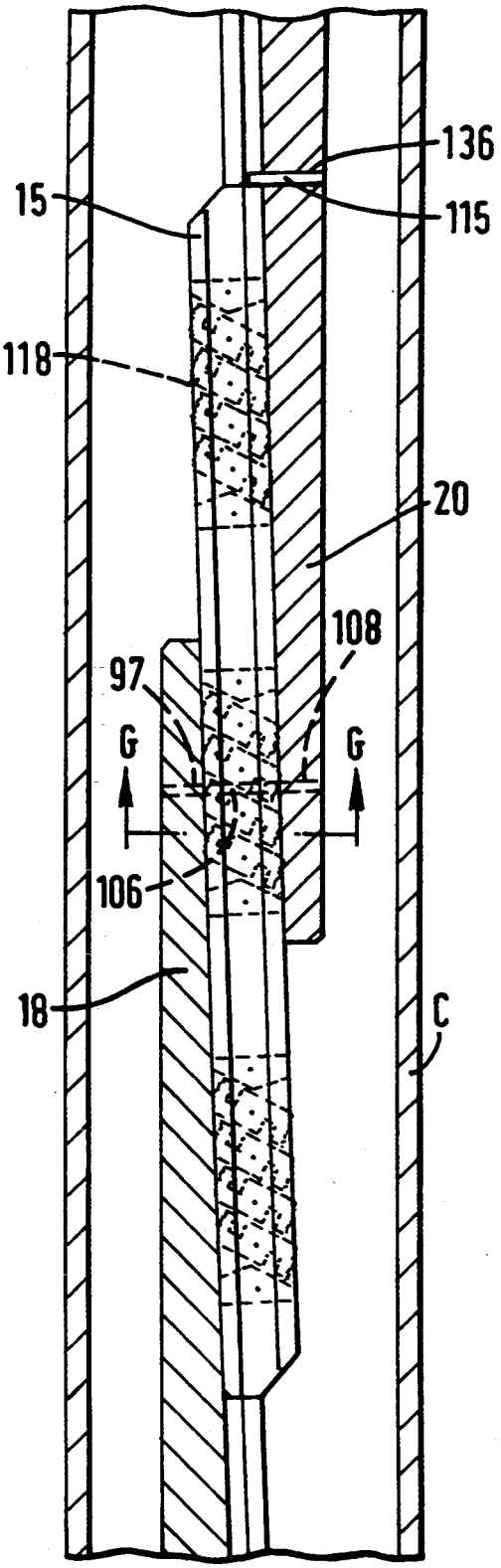
FIG. 3 is a side cross-sectional view of a connecting bar of the system of FIG. 1.
Figure 55:
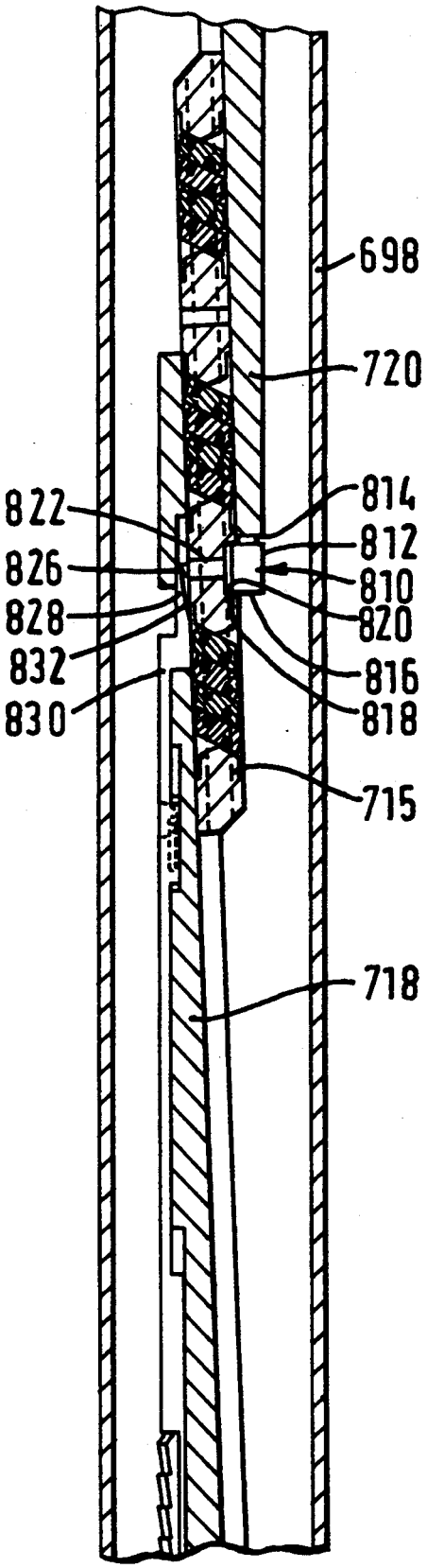
FIG. 55 is a side view in cross-section of an enlargement of a connecting bar of the system of FIG. 53A with upper and lower body members associated therewith.
Figure 56:
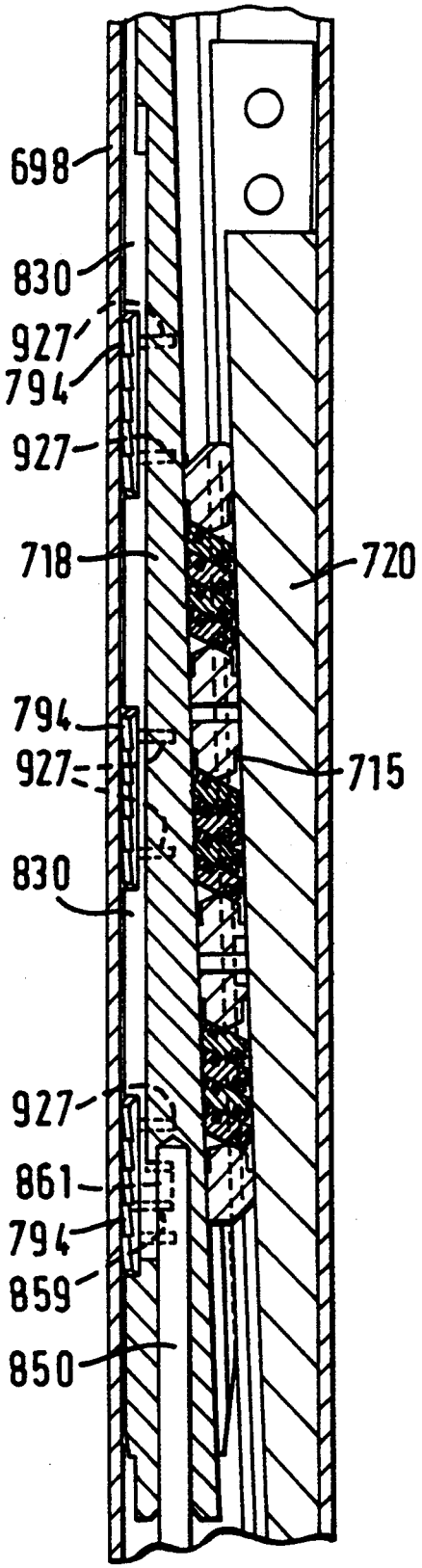
FIG. 56 shows a position of the items of FIG. 55 after system actuation.

FIGS. 53C, 55, and 56 show the connecting bar 715 and associated apparatus and connections. The bar 715 operates generally as does the connecting bar 15 of FIG. 3, but, a movable block 810 initially prevents the upper body member 720 from moving with respect to the lower body member 718. The movable block 810 has a head 812 which abuts a lower surface 814 of the upper body member 720. A lower surface 816 of the head 812 abuts an upper surface 818 of a recess 820 in the bar 715. A pin 822 contacts the block 810 and extends into the lower body member through the bar 715 and an end 826 of the pin 822 contacts a tongue 828 of a top rod member 830 which (as described below) is associated with rods extending downwardly through the center of the apparatus to contact an upper portion of an anchor member.

The head 812 of the block 810 and the tongue 828 of the rod member 830 are sized, configured, and positioned so that upward movement of the tongue 828 results in movement of the end 826 of the pin 822 up on a ramp portion 832 of the tongue 828, thereby effecting outward movement of the head 812 from the recess 820. At this point the bottom surface 816 of the head 812 no longer abuts the upper surface 818 of the recess 820. Thus downward force on the upper body member 720 results in movement of the upper body member 720 with respect to the connecting bar 715 and then movement of the connecting bar 715 and upper body member with respect to the lower body member 718. The tongue 828 does not move to push out the head 812 until the system is correctly oriented on the anchor member.

Figure 60:
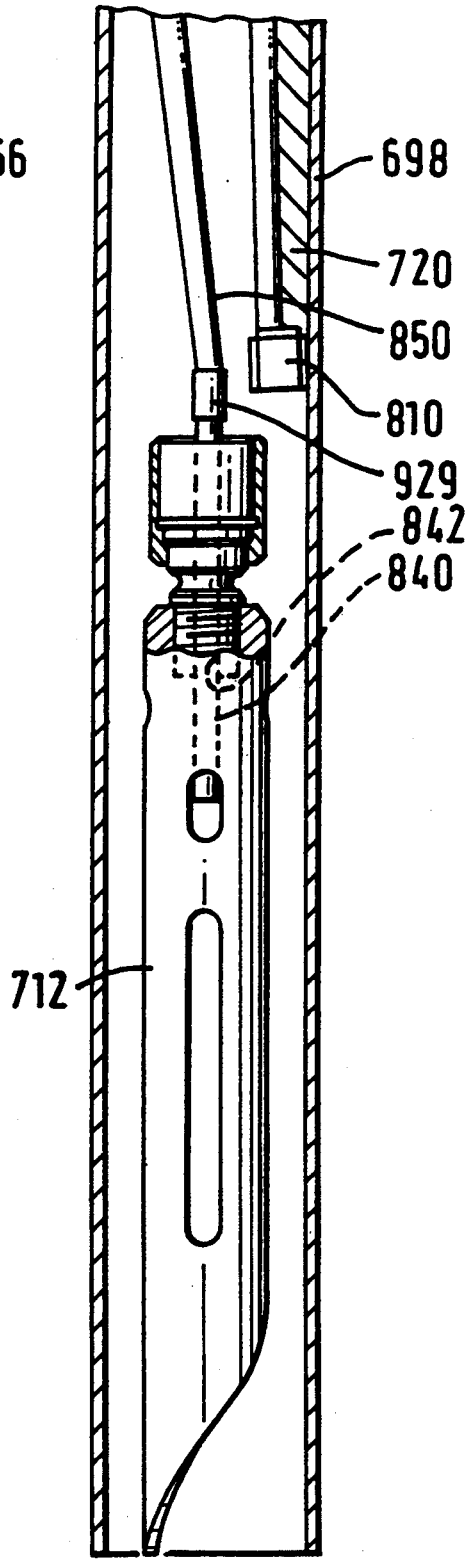
FIG. 60 shows a side view in cross-section of the apparatus of FIG. 59 after system actuation.

Referring now to FIGS. 53D, 54C, 59 and 60, the splined flexion member 714 (like the splined flexion member 314 of FIG. 18) has a central longitudinal (top-to-bottom) channel 842 therethrough through which movably extends a plunger rod 840. An end 844 of the plunger rod 840 extends into the receptacle 712 for contact by an upper end of an anchor member (not shown). As the receptacle 712 moves down to and over the anchor member, the upper end of the anchor member pushes the plunger rod upwardly through the splined flexion member 714. As the plunger rod 840 moves up, it in turn moves a middle rod 850 upwardly. The middle rod 850 movably extends through central longitudinal channels in the splined flexion member 714; in a central channel 847 of an adapter 848 (like the adapter 28 in FIG. 1); in a central channel 855 of a tube 856 welded to the lower body member 718; and in a central channel 857 of the lower body member 718. As shown in FIGS. 54C and 60, the middle rod 850 bends upon relative movement of the two body members.

The plunger rod 840 and the middle rod 850 may, according to this invention, be one integral rod; however such an integral rod would render more difficult a disassembly of the tool at various points, e.g. at the point of the splined flexion member. A collar 929 at the top of the plunger rod 840 prevents it from falling out of the receptacle.

A keyway 859 (FIG. 56) in the middle rod 850 receives and holds a key 861 of a top rod 830. To ease assembly there may be some play in the key-keyway fit, e.g. about one-sixteenth of an inch. Slips 794 (like the slips 94 of FIG. 10A) are held in place with screws 927 and have a rear keyway 862 (FIG. 65) which receives a portion of the top rod 830 which is movable therein. Thus the rod 830 is movable up and down with respect to the slips 794.

Figure 61:
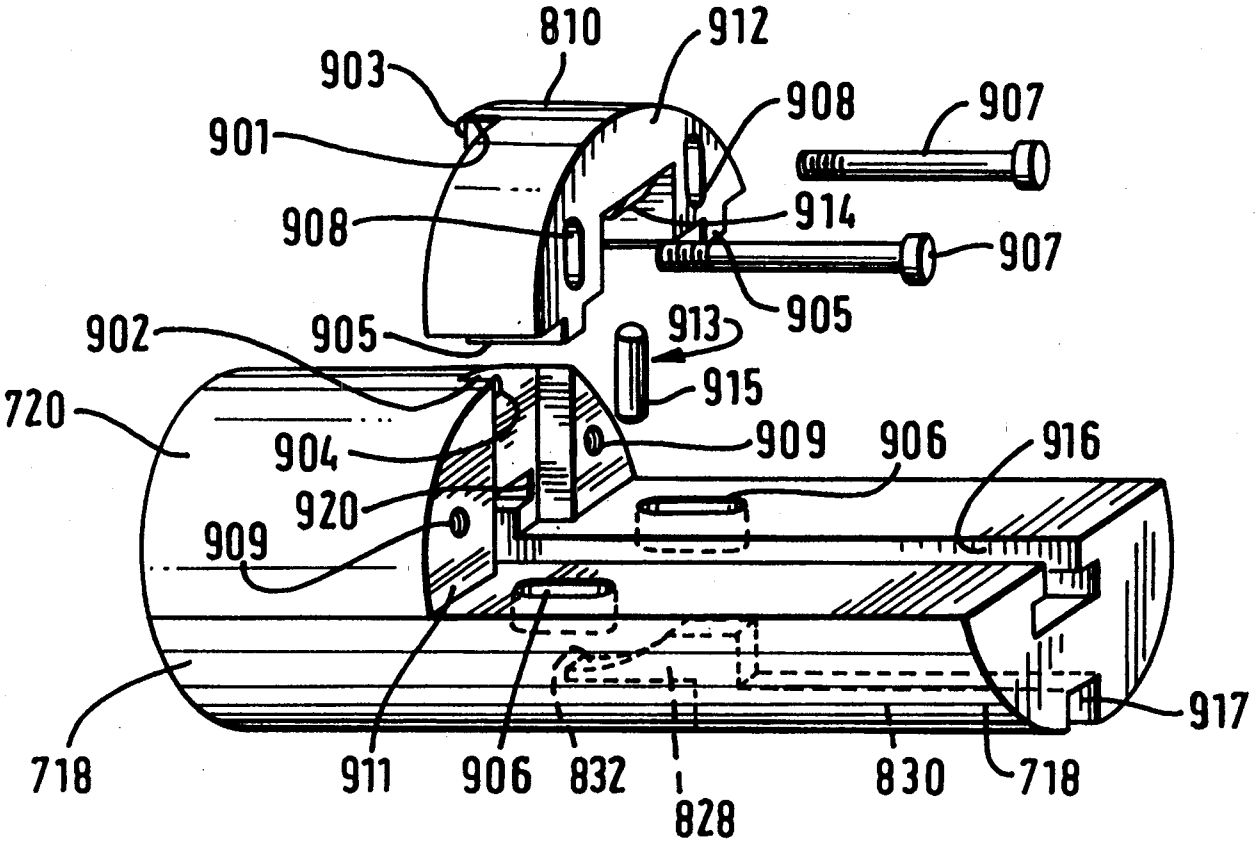
FIG. 61 is a perspective exploded view of a movable block, and upper and lower body members of the system of FIG. 53A.

FIG. 61 shows the movable block 810 which is movable with respect to the lower body 718. A rear key 901 on the block 810 is received in and movable in a keyway 902 with a corresponding shape in the upper body member 720. Initially a spring-loaded plunger detent 903 projects into a detent hole 904 in the upper body member 720 to prevent movement of the block 810 with respect to the upper body member. Two bottom keys 905 rest in bottom recesses 906 in the lower body 718 preventing longitudinal movement of the block 810 with respect to the lower body until the block 810 is moved sufficiently outwardly to free the bottom keys 905 from the recesses 906. Bolts 907 extend through enlarged slots 908 in the block 810 and are secured in bolt holes 908 in a surface 911 of the upper body member 720. After the block 810 has moved in the keyway 902 away from the lower body member 718, the bolts 907 still secure the movable block 810 to the upper body member 720. A pin 822 has a top end which contacts a stub 914 of the block 810 and a bottom end 915 which projects into a channel 916 for contact by the tongue 828 (FIG. 62) of the top rod 830. The tongue 828 and top rod 830 are sized and configured for movement in the channel 917 to contact the pin 913; overcome the force of the detent plunger 903 freeing the block 810 for movement; moving the block 810 outwardly from the lower body 718, freeing the bottom keys 905 from the recesses 906, and moving the block 810 with respect to the bolts 907 extending therethrough. At this point the bolts 907 connect the block 810 to the upper body 720 and the block 810 is free of the lower body 718 so that the upper body member 720 is freed for movement with respect to the lower body member and the connecting bar to set a tool or whipstock system.

Figure 62:
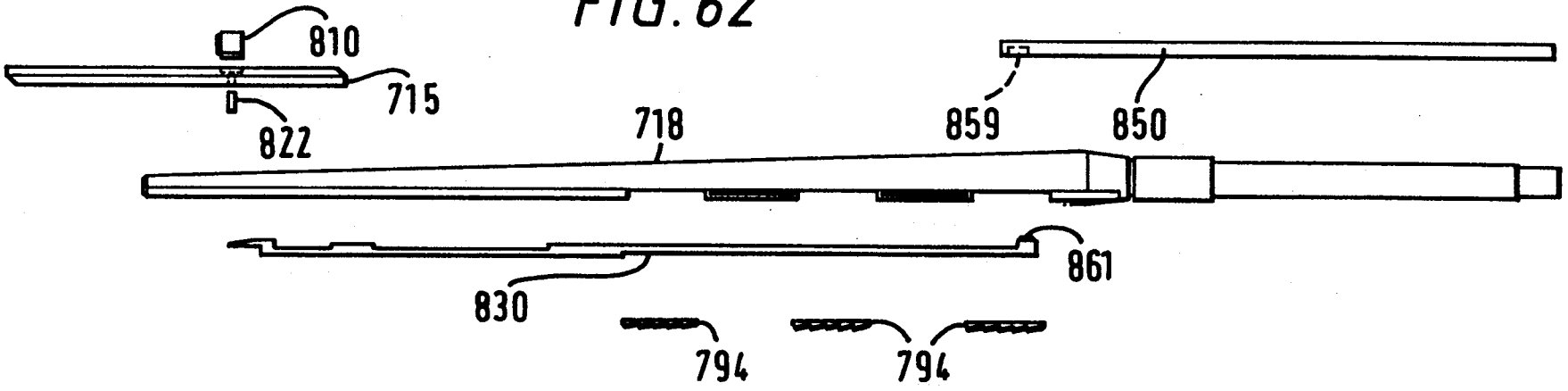
FIG. 62 is an exploded side view showing a top rod and a middle rod of the system of FIG. 53A and other related structures.
Figure 65:
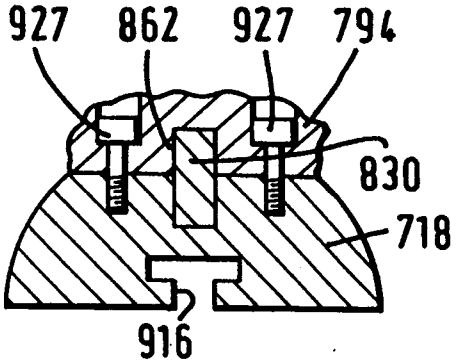
FIG. 65 is a cross-sectional view of slips, lower body, and top rod of the system of FIG. 53A.
Figure 64:
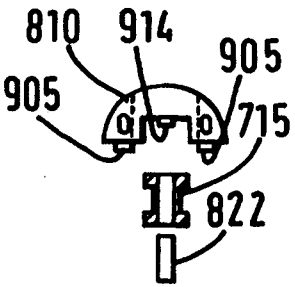
FIG. 64 is an end view of a movable block of FIG. 61.
Figure 63:
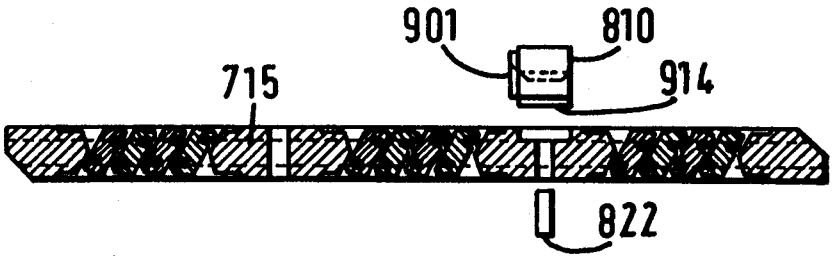
FIG. 63 is a side view of a connecting bar according to the present invention.

FIG. 62 shows an exploded view of the top rod 830, associated slips 794, the lower body member 718, the middle rod 850, the connecting bar 715, the pin 822, and the movable block 810. FIG. 63 is an enlarged view of the connecting bar 715, pin 822 and movable block 810. FIG. 64 is an end view of the movable block 810, the connecting bar 715 and the pin 822. FIG. 65 shows a cross-sectional view which reveals the relationship of one of the slips 794, its rear keyway 862, the top rod 830 and the lower body member 718.

Figure 66A:
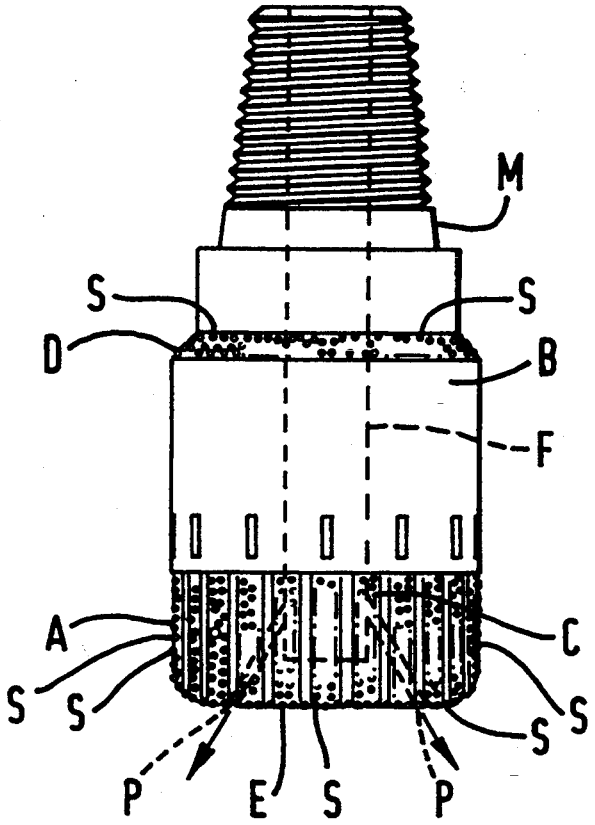
FIG. 66A (PRIOR ART)
FIG. 66A is a side view of a prior art milling tool.
Figure 66B:
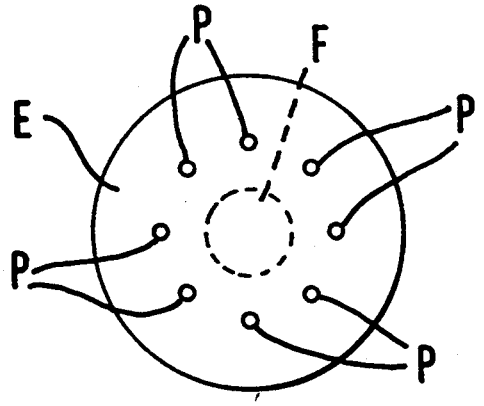
FIG. 66B (PRIOR ART)
FIG. 66B is a bottom end view of the tool of FIG. 66A.

FIGS. 66A and 66B shows a prior an milling tool M (e.g. a diamond speed mill) with a mill body B having a circulating-cooling central fluid flow channel F therethrough which intercommunicates with a plurality of fluid flow channels C each having a flow exit port P on a bottom end E of the body B. A plurality of milling elements S are disposed on a circumferential side surface A of the body B, and on the end E.

Figure 67:
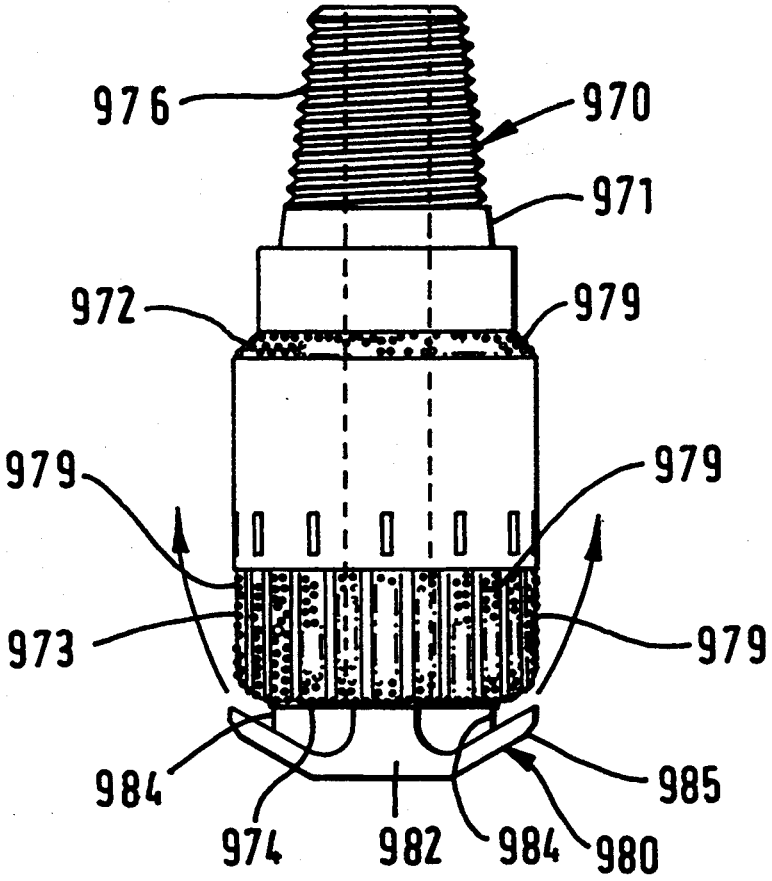
FIG. 67 is a side view of a milling tool according to the present invention with a bottom flow director in cross-section.
Figure 69:
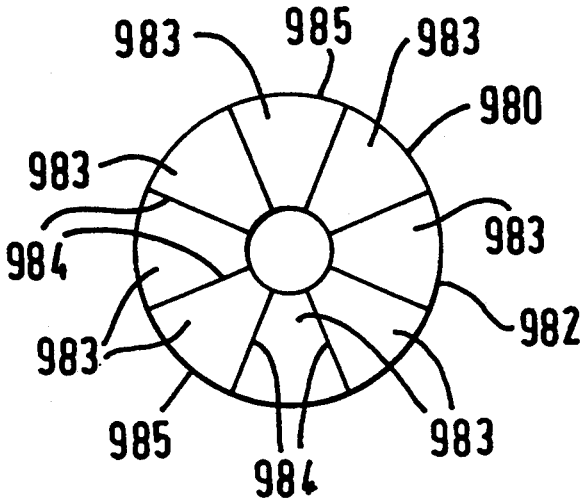
FIG. 69 is a top plan view of the flow director of the tool of FIG. 67.

FIG. 67 shows a milling tool 970 according to the present invention which has a tool body 971 with a shoulder 972 and lower milling head 973. The tool 970 has fluid flow ports and a central channel (not shown) like those of the tool M of FIG. 66A. A flow director 980 is secured to a bottom end 974 of the tool body 971 (secured e.g. by epoxy, screws, and/or bolts; bolts and screws are preferably disposed off-center with respect to the flow director 980 and off-center and away from the central flow channel through the tool body). As shown in FIG. 69 the flow director has a body 982 and a series of flow directing chambers 983 defined by side walls 984 and an upturned lip or end wall 985. One chamber corresponds to each flow port and exit opening. It is within the scope of this invention to eliminate the side walls 984. An upper threaded end 976 provides for threaded engagement of the tool 970 with other connectors or tools. Arrows indicate fluid flow direction. Milling elements 979 (e.g. but not limited to diamond milling elements which work more effectively when cooled by the flowing fluid) are on the circumferential side surface of the lower milling head 973, on the shoulder 972 and on the bottom end 974. The curved corner shaped of the flow director 980 facilitates coaction of a milling tool with a concave surface of a whipstock's concave member. With a flow director made of aluminum or plastic, such a flow director can be easily worn away by a formation after a side milling operation is completed to expose milling elements on the lower end of the tool body.

Figure 70:
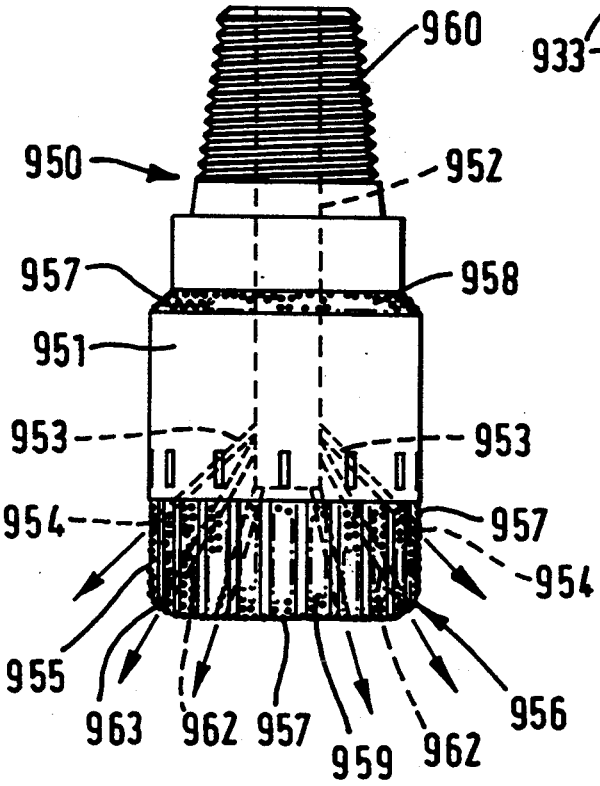
FIG. 70 is a side view of a milling tool according to the present invention.

FIG. 70 shows a mill 950 according to the present invention with a mill body 951 having a central circulating fluid flow channel 952 therethrough which communicates with a plurality (one or more) side fluid flow ports 953 each having an exit opening 954 on a circumferential side surface 955 of a mill head 956. A plurality of milling elements 957 are on the side of the tool and on an upper shoulder 958 and lower end 959. A top end 960 of the mill 950 is threaded. This tool may also have one or more fluid flow ports 962 with an exit opening at a lower corner 963 of the mill head 956 (like those of the tool in FIG. 68A).

Figure 68A:
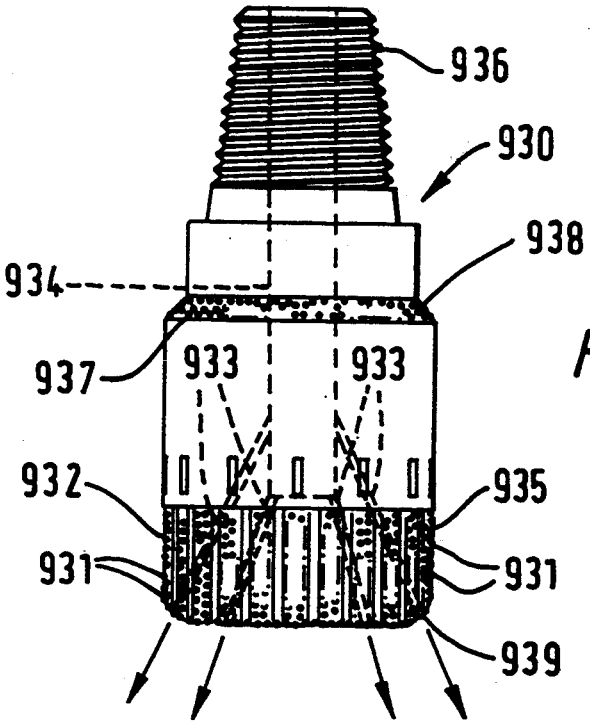
FIG. 68A is a side view of a milling tool according to the present invention.
Figure 68B:
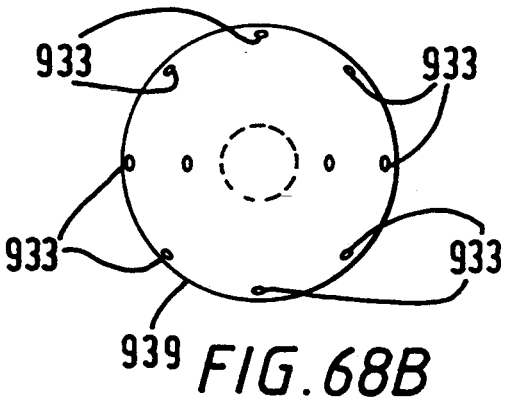
FIG. 68B is a bottom end view of the milling tool of FIG. 68A.

FIG. 68A shows a mill 930 with a head 935 with milling elements 931 on a side circumferential surface 932 thereof. Such elements may also be used on the bottom end of the tool. A plurality of fluid flow ports 933 communicate with a central fluid flow channel 934 through the mill 930 to provide fluid to exit at bottom end comers 939 on the mill 930 to cool the elements 931. The mill 930 has an upper threaded end 936 for interconnection with other wellbore apparatuses. Milling material and/or elements 937 may be provided on an upper shoulder 938 of the mill 930.

In conclusion, therefore, it is seen that the present invention and the embodiments disclosed herein and those covered by the appended claims are well adapted to carry out the objectives and obtain the ends set forth. Certain changes can be made in the subject matter described, shown and claimed without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. An indicator device for indicating correct orientation of an orienting receptacle and an associated wellbore tool secured to the orienting receptacle with respect to an anchor fixed in an interior of a longitudinal channel, the anchor having a top end, the indicator device comprising a rod having a top end and a bottom end and movably disposed in and extending through a tool central channel of the wellbore tool and with a bottom portion extending into the orienting receptacle, the bottom end of the rod disposed for contact by the top end of the anchor and the rod movable upwardly in the tool central channel by the top end of the anchor as the orienting receptacle moves down on the anchor to correctly orient the wellbore tool.

2. The indicator device of claim 1 wherein tool setting apparatus is interconnected with the wellbore tool for setting the wellbore tool in the wellbore, the tool setting apparatus having a holding device preventing tool setting, the indicator device further comprising the rod movable in response to the top end of the anchor to move the top end of the rod to contact the holding device and move it so it no longer prevents tool setting.

3. The indicator device of claim 2 wherein the wellbore tool includes a whipstock system with an upper body member movable with respect to a lower body member and the tool setting apparatus includes at least one gripping element movable to engage the interior surface of the longitudinal channel, the longitudinal channel comprising a channel through the interior of an oil well tubular member, the holding device initially preventing movement of the upper body member with respect to the lower body member, the upper body member having a whipstock concave member thereon.

4. The indicator device of claim 3 wherein the holding device has a movable block which initially contacts the lower body member and the upper body member preventing relative movement of the two body members, and the indicator device further comprising the rod movable to contact and move the movable block away from the lower body member freeing the upper body member for movement with respect to the lower body member.

5. The indicator device of claim 1 wherein the rod is comprised of at least two sub-rods releasably secured together.

6. A wellbore tool system for disposition in a longitudinal bore channel above and with respect to an anchor secured in the longitudinal bore channel, the anchor having a top end, the system comprising a wellbore tool having a top end, a bottom end, and a longitudinal tool channel therein, an orientation receptacle for receiving and contacting the top end of the anchor for orientation with respect thereto to orient the wellbore tool with respect to the longitudinal bore channel, the orientation receptacle secured beneath the wellbore tool and having a longitudinal orienting channel therein, a movable rod with a top portion movably disposed in the longitudinal tool channel in the wellbore tool, and with a bottom portion with a bottom end projecting into the longitudinal orienting channel of the orientation receptacle for contact of the bottom end of the rod by the top end of the anchor for upward movement of the rod indicating that the orientation receptacle and its associated wellbore tool are correctly oriented with respect to the anchor and the longitudinal bore channel.

7. The system of claim 6 further comprising setting apparatus for securing the wellbore tool in place in the longitudinal bore channel, holding apparatus for initially preventing actuation of the setting apparatus, and the rod movable in response to the top end of the anchor to contact the holding apparatus and move the holding apparatus so that the setting apparatus is freed to set the wellbore tool in place.

8. The system of claim 7 further comprising the wellbore tool includes a whipstock system, the whipstock system having an upper body member with a concave upper portion and a lower body member interconnected with the orientation receptacle, and the holding apparatus further comprising a connection bar interconnected between the two body members and movable with respect thereto to guide their movement with respect to each other.

9. The system of claim 8 further comprising the holding apparatus having a movable block movably secured to the upper body member and initially contacting the lower body member and preventing relative movement of the two body members thereby preventing setting of the whipstock system in place, the rod movable in response to orienting of the orientation receptacle with respect to the anchor to move the movable block away from the lower body member freeing the body members for movement to permit setting of the whipstock system.

10. The system of claim 8 further comprising an installation tool removably secured to the upper body member and securable to a string of tubular members for inserting the whipstock system into the string of tubular members.

11. The system of claim 10 wherein the longitudinal bore channel is a central channel through a string of casing in a wellbore.

12. The system of claim 10 further comprising connection apparatus interconnecting the lower body member and the orientation receptacle, the rod extending through and movable through the connection apparatus.

13. The system of claim 10 further comprising the rod including three sub-rods releasably secured together in the connection apparatus.

14. A whipstock system for use in an interior central casing bore of a string of wellbore casing, the system comprising an upper body member with a concave upper portion, a lower body member, a connection bar interconnected between the upper body member and the lower body member and movable with respect thereto and for guiding their movement with respect to each other, a movable block contacting the two body members preventing their relative movement, thereby preventing setting of the system in the casing bore, an installation tool removably secured to the upper body member and securable to apparatus for inserting the whipstock system into the casing bore, an orientation receptacle for receiving and contacting the top end of an anchor in the casing bore beneath the whipstock system for orientation with respect thereto to orient the whipstock system with respect to the casing bore, the orientation receptacle secured beneath the lower body member and having a longitudinal orienting channel therein, a movable rod with a top portion movably disposed in a longitudinal tool channel in the lower body member, and with a bottom portion with a bottom end projecting into the longitudinal orienting channel of the orientation receptacle for contact of the bottom end of the rod by the top end of the anchor for upward movement of the rod when the orientation receptacle and its associated whipstock system are correctly oriented with respect to the anchor and the casing bore to move the movable rod to move the movable block out of contact with the lower body member thereby freeing the two body members for relative movement to set the whipstock system in place in the casing bore.

* * * * *